US005606342A

United States Patent [19]

Shoji et al.

[11] Patent Number: 5,606,342

[45] Date of Patent: Feb. 25, 1997

[54] LIQUID CRYSTAL DISPLAY SYSTEM

[75] Inventors: Masato Shoji; Hoko Hirai; Susumu Kondo; Akio Murayama, all of Kanagawa-ken, Japan

[73] Assignee: Kabushiki Kaisha Toshiba, Kawasaki, Japan

[21] Appl. No.: 400,014

[22] Filed: Mar. 6, 1995

Related U.S. Application Data

[63] Continuation of Ser. No. 197,547, Feb. 17, 1994, abandoned, which is a continuation of Ser. No. 837,922, Feb. 20, 1992, abandoned.

[30] Foreign Application Priority Data

| | | | |
|---|---|---|---|
| Feb. 20, 1991 | [JP] | Japan | 3-047827 |
| Feb. 28, 1991 | [JP] | Japan | 3-058197 |
| Apr. 26, 1991 | [JP] | Japan | 3-096890 |
| Jan. 31, 1992 | [JP] | Japan | 4-015690 |

[51] Int. Cl.[6] ..... G09G 3/36

[52] U.S. Cl. ..... 345/94; 345/97

[58] Field of Search ..... 359/84, 85, 55–57; 345/97, 94, 92, 90, 89, 87

[56] References Cited

U.S. PATENT DOCUMENTS

| | | | |
|---|---|---|---|
| 4,048,633 | 9/1977 | Sano | 340/784 |
| 4,223,308 | 9/1980 | Baraff et al. | 345/92 X |
| 4,649,383 | 3/1987 | Takeda et al. | 340/805 |
| 4,675,667 | 6/1987 | Nakamura et al. | 345/92 |
| 4,714,921 | 12/1987 | Kanno et al. | 345/97 X |
| 4,782,340 | 11/1988 | Czubatyj et al. | 345/92 X |
| 4,859,035 | 8/1989 | Ichinose et al. | 340/793 X |
| 5,014,048 | 5/1991 | Knapp | 340/784 |

FOREIGN PATENT DOCUMENTS

| | | |
|---|---|---|
| 0345399 | 12/1989 | European Pat. Off. . |
| 0358486 | 3/1990 | European Pat. Off. . |
| 62-287226 | 12/1987 | Japan . |
| 2-6921 | 1/1990 | Japan . |

OTHER PUBLICATIONS

Robert L. Boylestad, *Introductory Circuit Analysis,* Merrill Publishing Company, 1987, pp. 398–402.

Y. Asai et al, "A 6.7–in Square High–Resolution Full–Color TFT–LCD", Japan Display, 1989, pp. 514–517.

*Primary Examiner*—Ulysses Weldon

*Attorney, Agent, or Firm*—Oblon, Spivak, McClelland, Maier & Neustadt, P.C.

[57] ABSTRACT

In liquid crystal display system 10 which has a matrix arrangement of scanning electrode group 12 and data electrode group 13 and in which each electrode group is driven by a pulse like waveform, this is a liquid crystal display system in which a lower level region than the pulse wave peak value is formed in at least one of the rising or the falling portions of the pulse wave which drives at least one of the electrode groups.

A liquid crystal display system with a uniform display with extremely little display non-uniformity can be obtained.

7 Claims, 23 Drawing Sheets

(a) AND (b) COMPOSITE WAVEFORM (a) AND (c) COMPOSITE WAVEFORM (a) AND (d) COMPOSITE WAVEFORM (a) AND (e) COMPOSITE WAVEFORM

WAVEFORM OF DATA ELECTRODES (ON)

WAVEFORM OF DATA ELECTRODES (OFF)

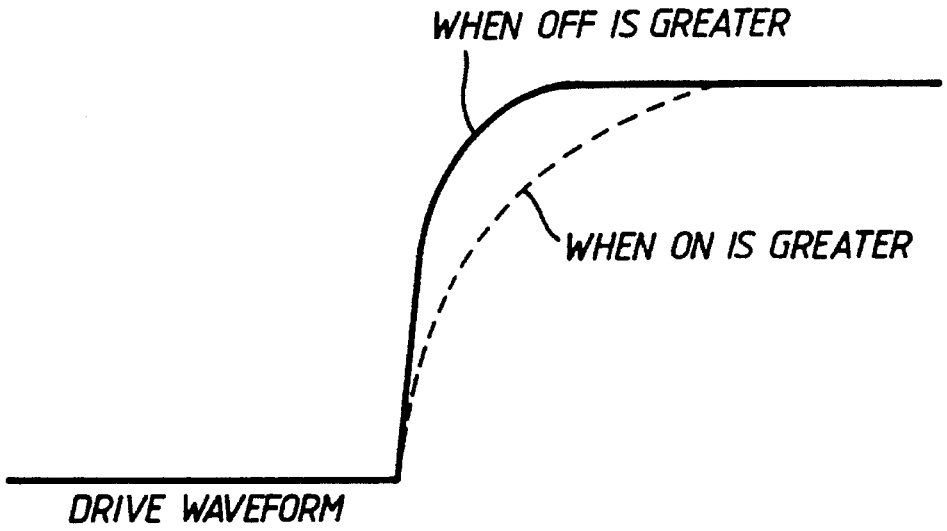
Fig. 6.
Fig. 7. (a)
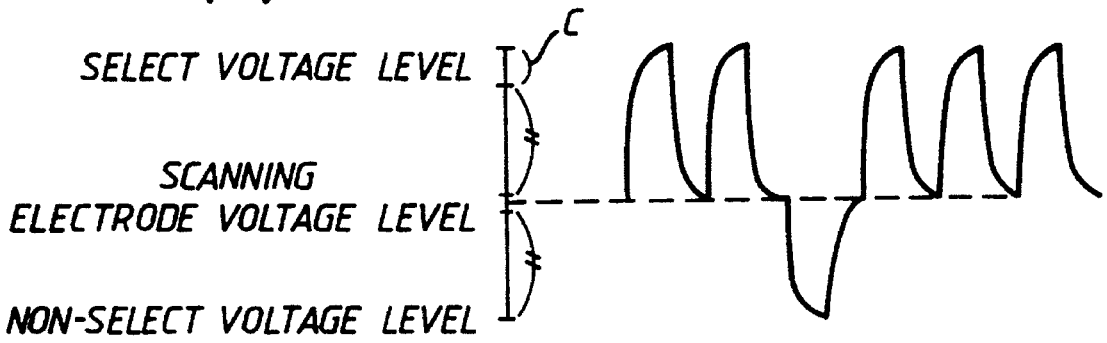
Fig. 7. (b)
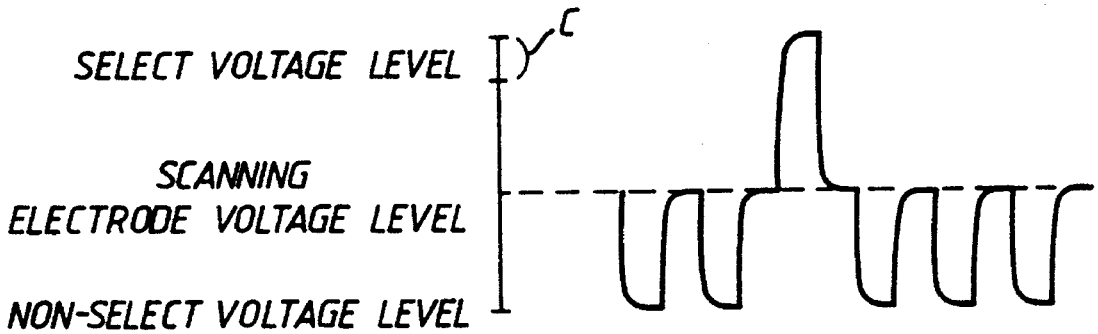

Fig.8. (a)
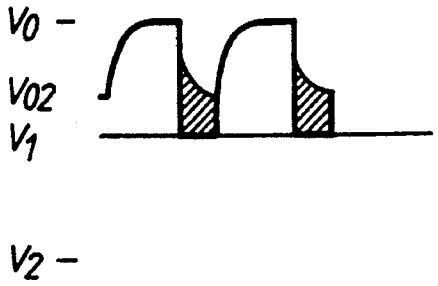
Fig.8. (b)
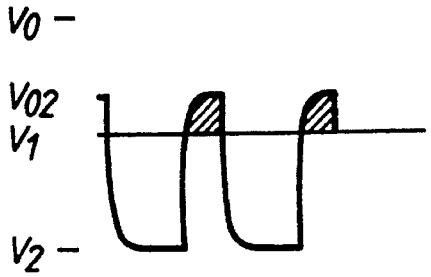
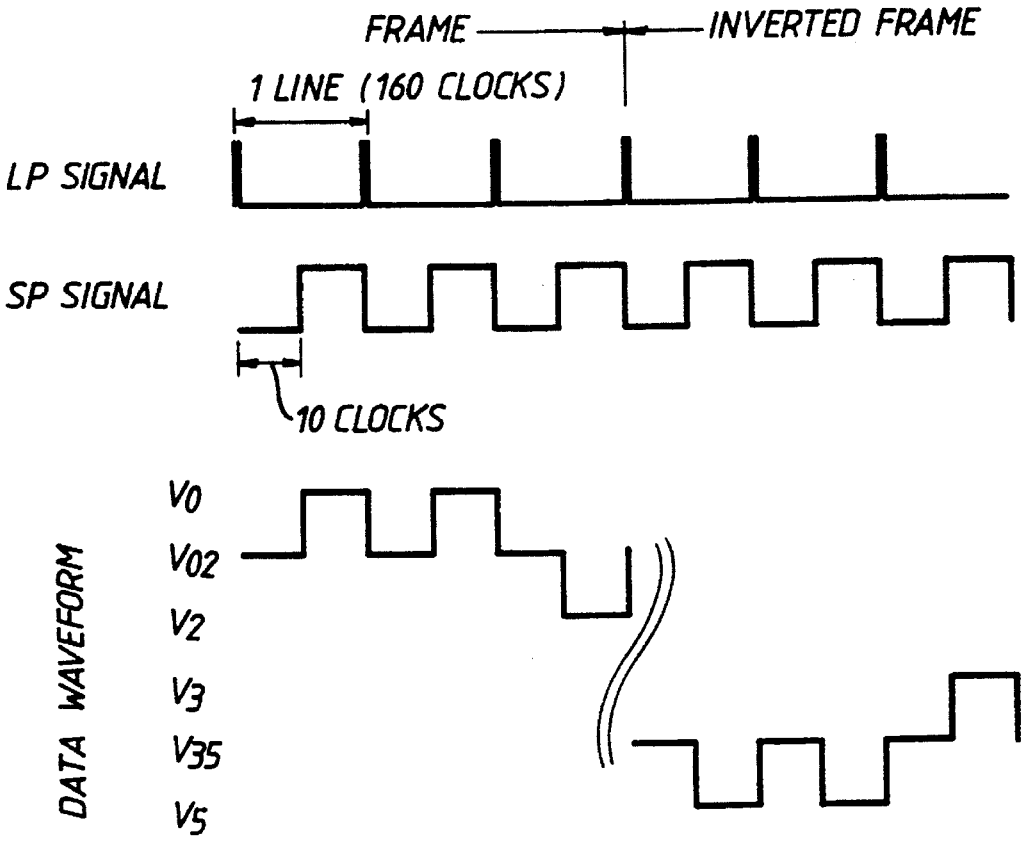
Fig. 9.

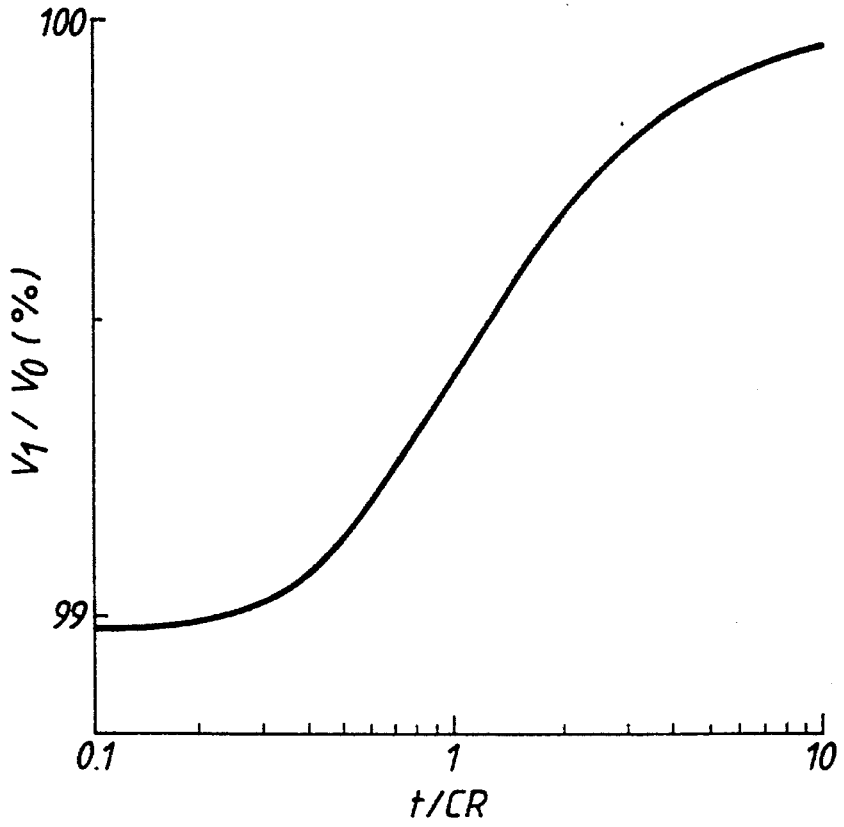
Fig. 14.
Fig.15.
(a)
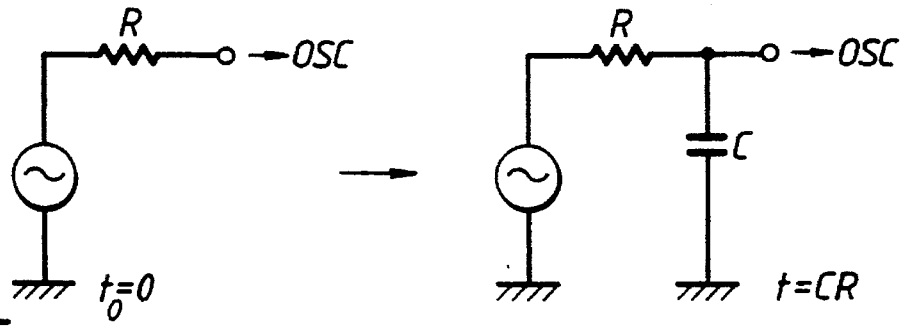
Fig.15.
(b)
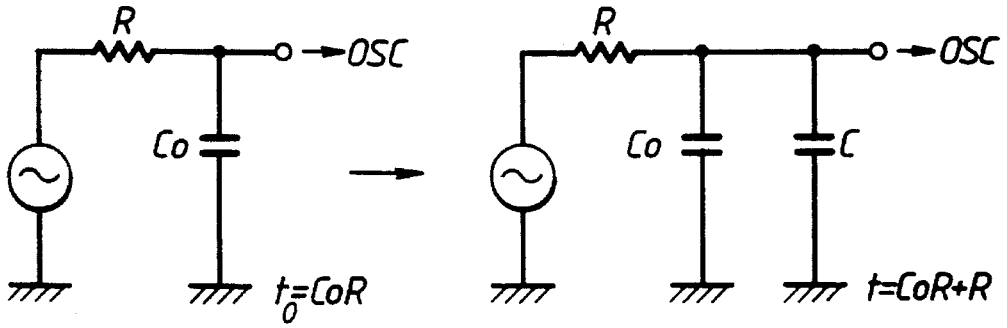

(a)

(b)

(c)

| tx (μS) | 0.25 | 0.35 | 0.5 | 0.6 | 1.0 | 1.8 |
|---|---|---|---|---|---|---|
| to (μS) | 0.0 | 0.1 | 0.25 | 0.4 | 0.8 | 1.6 |
| tx / fo | — | 3.5 | 2.0 | 1.5 | 1.25 | 1.13 |
| tx/CR | 0.51 | 0.71 | 1.0 | 1.22 | 2.04 | 3.67 |
| EFFECT | REF. | × | △ | ○ | ○ | ◎ |

REF. : REFERENCE × : HARDLY ANY DIFFERENCE FROM REF.
△ : HAS A SLIGHT EFFECT ○ : HAS AN EFFECT
◎ : HAS A LARGE EFFECT

Fig.20.

| ty (μS) | 0.5 | 0.9 | 1.25 | 2.0 | 4.0 | 7.0 |
|---|---|---|---|---|---|---|
| to (μS) | 0.0 | 0.4 | 0.8 | 1.6 | 3.55 | 6.6 |
| ty / fo | — | 2.25 | 1.56 | 1.25 | 1.13 | 1.06 |
| ty/CR | 0.12 | 0.21 | 0.3 | 0.48 | 0.95 | 1.66 |
| EFFECT | REF. | × | △ | ○ | ○ | ◎ |

REF. : REFERENCE × : HARDLY ANY DIFFERENCE FROM REF.
△ : HAS A SLIGHT EFFECT ○ : HAS AN EFFECT
◎ : HAS A LARGE EFFECT

Fig. 21.

LIQUID CRYSTAL DISPLAY SYSTEM

This application is a Continuation of application Ser. No. 08/197,547, filed on Feb. 17, 1994, now abandoned, which is a Continuation of application Ser. No 07/837,922, filed on Feb. 20, 1992, abandoned.

BACKGROUND OF THE INVENTION

1. Field of the Invention

This invention concerns liquid crystal display systems which are multiplex driven.

2. Description of the Prior Art

A matrix type liquid crystal display system is provided with electrode groups in which a large number of fine lines made of a transparent conductor such as indium-tin oxide are arranged in parallel on the inner surfaces of 2 substrates made of transparent glass which face each other. These are arranged so that they cross each other with a gap between them and have cells between them in which liquid crystal is placed. Images are formed on the surface of the liquid crystal display by applying waveforms of select-voltage level or non-select voltage level to these electrodes line by line.

Since the application of a direct current voltage to liquid crystal decomposes and degrades the liquid crystal, the liquid crystal cell drive is carried out by an alternating current voltage waveform. In practice, frame inversion is used which reverses the polarity of the drive voltage every frame, However, display non-uniformity, such as the crosstalk phenomenon on the screen, often occurs depending on the display pattern. For this reason, the N-line inversion method was developed by alternating the current every scanning electrode N-line by making the polarity inversion cycle shorter than 1 frame. However, even driving by this type of inversion method, display non-uniformity still occurred and, with the demand for larger screens and gray scale displays, this became a great problem.

As the causes of display non-uniformity, it is considered that the electrical resistance of the electrode lines of the liquid crystal display panel, the electrostatic capacity of the liquid crystal, the dielectric anisotropy of the liquid crystal and the frequency dependence all have their effects.

FIG. 27(*a*) shows the data waveform outputted from a data electrode drive device. Here, if the scanning waveform outputted from the scanning electrode drive device in the 1 frame period shown in FIG. 27(*a*) is taken as the intermediate voltage V1 between V0 and V2 and in the inverted frame period as intermediate voltage V4 between V3 and V5, the voltage waveform actually applied to the liquid crystal cell at this time becomes as in FIG. 27(*b*). For reference, the scanning voltage is also shown in the same Figure. That is to say, V0 and V5 in the Figure show the voltage level (select data voltage level Vds) which designates the ON state in a pixel when the scanning electrode is not driven, and V2 and V3 show the voltage level (non-select data voltage level Vdn) which designates the OFF state in a pixel. Therefore, the voltage outputted from the data electrode drive device changes as in FIG. 27 depending on the content which it is wished to display.

Moreover, even if a square waveform such as (a) is applied from the data electrode drive device, the voltage waveform (b) actually applied to the liquid crystal is distorted and distortion occurs in the rising and falling portions.

The amount of this varies by a time constant depending on the resistance of the electrode line and the electrostatic capacity of the liquid crystal. Also, since the number of polarity reversals differs depending on the display pattern, the size of the distortion varies. For this reason, the larger the distortion and the greater the number of polarity reversals, the more the effective voltage value applied to the liquid crystal reduces. When this type of reduction of the effective voltage value occurs, the select and non-select states of the liquid crystal cannot accurately be switched. Also, it results in unsatisfactory switching, and is therefore considered to be a cause of display non-uniformity.

However, since the electrode lines of the liquid crystal display panel must be formed thinly and finely in order to ensure light transmissivity and the required number of pixels, there is a limit to the reduction of this line resistance. Also, the electrostatic capacity, the dielectric anisotropy and the frequency dependence of the liquid crystal are all inherent properties and cannot be eliminated.

In Japanese Patent Laid-Open Showa 62-287226 and Japanese Patent Laid-Open Heisei 2-6921, examples have been disclosed in which the number of waveform subjected to distortion is made constant by providing a period in which the voltage applied to the liquid crystal display panel is made 0 V in every scanning period, and does not depend on the display constant. However, since no consideration has been given to the size of the distortion in these examples, not only is the effect on display non-uniformity unsatisfactory, but there are also cases when the display non-uniformity is, rather, made worse. That is to say, in these examples, there is display non-uniformity which occurs due to the reduction of the RMS voltage because the distortion gradually becomes greater from the pixels close to the electrode drive device of the liquid crystal panel to the distant pixels, and display non-uniformity caused by changes in the electrostatic capacity due to the ON/OFF switching of pixels. Thus, not only is there no effect on display non-uniformity due to the difference of the size of the distortion, but also, since, as a result, the number of times distortion occurs increases, these examples have the effect of increasing display non-uniformity.

SUMMARY OF THE INVENTION

Accordingly, one object of the present invention is to obtain a liquid crystal display system with less display non-uniformity by the collective consideration of the number of times the waveform of the driving pulse applied to the liquid crystal display panel is subject to distortion and the magnitude of the distortion.

Briefly, in accordance with one aspect of the present invention, there is provided a liquid crystal display system which provides distortion or delay beforehand to the waveform of the driving pulse applied to the liquid crystal display panel, and adjusts the number of times distortion is undergone and the size of distortion. By this means, it prevents display non-uniformity by a making the reduction of the RMS voltage due to the influence of waveform distortion uniform in all the pixels.

That is to say, a liquid crystal display system comprises;

a liquid crystal display panel in which a scanning electrode group and a data electrode group, each composed of multiple electrodes, are positioned facing each other with a gap, liquid crystal is sandwiched between the electrodes and pixels are formed at the positions where the scanning electrodes and the data electrodes cross each other;

a scanning electrode drive device connected to the scanning electrode group to output a scanning waveform containing at least a select voltage level Vss and a non-select voltage level Vsn;

a data electrode drive device connected to the data electrode group to output a data waveform containing at least a select voltage level Vds and a non-select voltage level Vdn; and a voltage level control means for setting at least one of the scanning waveform or the data waveform at a voltage level between the select voltage level (Vss or Vds) and the non-select voltage level (Vsn or Vdn), every scanning period being the output period for the minimum unit display information which determines the liquid crystal display state, for a predetermined period which is at least either at the beginning or the end of the scanning period.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6 is a waveform diagram to illustrate the operation of the fourth and fifth aspects in the invention;

FIG. 7 is a waveform diagram to illustrate the operation of the fourth aspect in the invention;

FIG. 8 is a waveform diagram to illustrate the operation of the fifth aspect in the invention;

FIG. 9 is a waveform diagram to illustrate the operation of Embodiment 1 in the invention;

FIG. 14 is a diagram to illustrate the operation of the eighth aspect in the invention;

FIG. 15 is an equivalent circuit diagram to illustrate the operation of the sixth and eighth aspects in the invention;

FIG. 20 is a diagram to illustrate Embodiment 10 in the invention;

FIG. 21 is a diagram to illustrate Embodiment 11 in the invention;

DESCRIPTION OF THE PREFERRED EMBODIMENTS

Figure 1:
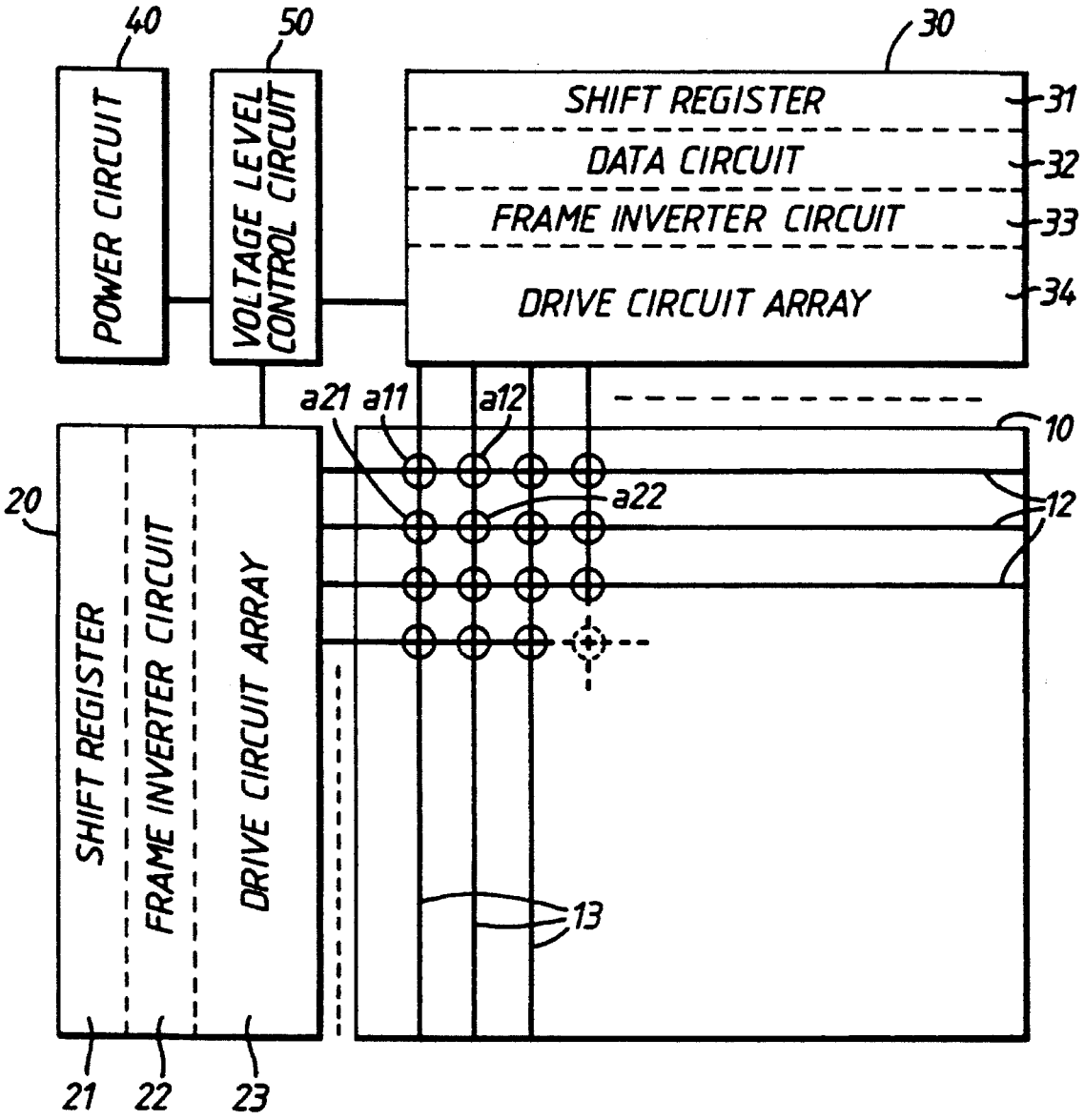
FIG. 1 is a schematic diagram of the liquid crystal display system of an embodiment of the invention.

Hereinafter, several aspects and embodiments of a liquid crystal display system according to the present invention will be described with reference to the according drawings, wherein like numerals designate identical or corresponding parts in the Figures.

As this system, the following practical aspect of the invention are proposed.

The first aspect of the invention sets an intermediate voltage level Vdm in the data waveform.

That is to say, in a liquid crystal display system comprising a liquid crystal display panel in which a scanning electrode group and a data electrode group, each composed of multiple electrodes, are positioned facing each other with a gap, liquid crystals are sandwiched between these and pixels are formed at the positions where the scanning electrodes and the data electrodes cross each other;

a scanning electrode drive device which is connected to the scanning electrode group and outputs a scanning waveform containing a select voltage level Vss and a non-select voltage level Vsn; and a data electrode drive device which is connected to the data electrode group and outputs a data wave from containing a select voltage level Vds and a non-select voltage level Vdn, this is a liquid crystal display system which has the characteristic of being provided with a first voltage level control means which sets the data waveform at a voltage level which is either the select voltage level Vds, the non-select voltage level Vdn or an intermediate voltage level Vdm which is a voltage level between the select voltage level Vds and the non-select voltage level Vdn;

a second voltage control means which sets the data waveform at an intermediate voltage level Vdm every scanning period, which is the output period for the minimum unit display information which determines the liquid crystal display state, for a specified period which is at least either at the beginning or the end of the scanning period; and a third voltage control means which makes the period in which the scanning waveform takes select voltage level Vss longer than the period in which the data waveform takes select voltage level Vds or non-select voltage level Vdn every scanning period.

The second aspect of the invention sets an intermediate voltage level Vsm in the scanning waveform.

That is to say, in a liquid crystal display system having a liquid crystal display panel in which a scanning electrode group and a data electrode group, each composed of multiple electrodes, are positioned facing each other with a gap between them, liquid crystals are sandwiched between these and pixels are formed at the positions where the scanning electrodes and the data electrodes cross each other;

a scanning electrode drive device which is connected to the scanning electrode group and outputs a scanning waveform and a data electrode drive device which is connected to the date electrode group and outputs a data waveform, this is a liquid crystal display system which has the characteristic of being provided with a voltage level control means in which the scanning waveform takes any of the select voltage level Vss, the non-select voltage level Vsn or the intermediate voltage level Vsm, which is a voltage level between select voltage level Vss and non-sect voltage level Vsn, and which carries out at least one of switching from select voltage level Vss to non-select voltage level Vsn or switching from non-select voltage level Vsn to select voltage level Vss of the scanning waveform stepping through intermediate voltage level Vsm.

The third aspect of the invention has the characteristic that, in a control means provided in the second aspect, the data waveform takes any of the select voltage level Vds, the non-select voltage level Vdn or the intermediate voltage level Vdm, which is a voltage level between select voltage level Vds and non-select voltage level Vdn, and the device sets the data waveform at the intermediate voltage level Vdm, which is a voltage level between the select voltage level Vds and the non-select voltage level Vdn, every scanning period, which is the output period for the minimum unit display information which determines the liquid crystal display state, for a predetermined period which is at least either a the beginning or the end of the scanning period.

The fourth aspect of the invention determines the relationship between the voltage levels of the data waveform and the scanning waveform.

That is to say, it is liquid crystal display system which has the characteristic of being provided with a means which, when the select voltage levels Vds of respective inverted data waveforms are taken as V0 and V5 and the non-select voltage levels Vdn as V2 and V3, and the select voltage levels Vss of respective inverted scanning waveforms are taken as V0 and V5 and the non-select voltage levels Vsn as V1 and V4, sets the respective voltage levels in the relationship $$V0>V1>V2>V3>V4>V5$$

and also in the relationship $$(V0-V1)+(V4-V5)>(V1-V2)+(V3-V4).$$

The fifth aspect of the invention determines the relationship of intermediate voltage level Vdm to the voltage levels V0 to V5.

That is to say it is a liquid crystal display system which has the characteristic that, when the select voltage levels Vds of respective inverted data waveforms are taken as V0 and V65, the non-select voltage levels Vdn as V2 and V3 and the intermediate voltage levels Vdm as V02 and V35, and the select voltage levels Vss of respective inverted scanning waveforms are taken as V0 and V5 and the non-select voltage levels Vsn as V1 and V4, the respective voltage levels are in the relationship $$V0>V02>V1>V2>V3>V4>V35>V5$$

Also, the sixth aspect of the invention provides a delay time in at least one of the rising falling of the data waveform, and also sets the intermediate voltage level during that time.

In a liquid crystal display system having a liquid crystal display panel in which a scanning electrode group and a data electrode group, each composed of multiple electrodes, are positioned facing each other with a gap between them liquid crystals are sandwiched between these and pixels are formed at the positions where the scanning electrodes and the data electrodes cross each other;

a scanning electrode drive device which is connected to the scanning electrode group and outputs a scanning waveform having a select voltage level Vds and a non-select voltage level Vdn and a data electrode drive device which is connected to the data electrode group and outputs a data waveform having a select voltage level Vds and a non-select voltage level Vdn, this is a liquid crystal display system which has the characteristic of the data waveform having a rising or a falling with a predetermined delay time in at least one of the first or te last of the minimum unit pulses which determine the liquid crystal dislay state, and also taking a voltage level between the select voltage level Vds and the non-select voltage level Vdn.

The seventh aspect of the invention provides a delay time in at least one of the rising or the falling of the scanning waveform.

In a liquid crystal display system having a liquid crystal display panel in which a scanning electrode group and a data electrode group, each composed of multiple electrodes, are positioned facing each other with a gap between them, liquid crystals are sandwiched between these and pixels are formed at the positions where the scanning electrodes and the data electrodes cross each other;

a scanning electrode drive device which is connected to the scanning electrode group and outputs a scanning waveform having a select voltage level Vss and a non-select voltage level Vsn and a data electrode drive device which is connected to the data electrode group and outputs a data waveform having a select voltage level Vds and a non-select voltage level Vdn, this is a liquid crystal display system which has the characteristic of a scanning waveform switching means which the scanning waveform switches between select voltage level Vss and non-select voltage level Vsn while having a rising or a falling with a specified delay time.

The eighth aspect of the invention determines the delay time in relationship to the liquid crystal display panel in the liquid crystal display systems of the sixth and seventh aspect of the inventions.

That is to say, this is a liquid crystal display system which has the characteristic of a connecting means for connecting the liquid crystal display panel to a data electrode drive device and a scanning electrode drive device;

the delay time t of the rising or the falling of the output waveform at the output terminal of the data electrode drive device or the scanning electrode drive device when the pixels are all in the non-selected state and the time CR, determined by the electrostatic capacity C of the pixel on one electrode connected to the output terminal and the resistance R possessed by that electrode, being in the relationship $$0.3 \times CR \leqq t$$

and the delay time t being in the relationship $$t \leqq 2 \times t0$$

with the delay time t 0 of the output waveform at the output terminal of the electrode drive device in the state when the liquid crystal display panel is not connected.

Moreover, the ninth aspect of the invention sets an intermediate voltage level Vdm in the data waveform, and makes the value of this Vdm different values depending on whether it is a select pixel or a non-select pixel.

In a liquid crystal display system having a liquid crystal display panel in which a scanning electrode group and a data electrode group, each composed of multiple electrodes, are positioned facing each other with a gap between them, liquid crystals are sandwiched between these and pixels are formed at the positions where the scanning electrodes and the data electrodes cross each other;

a scanning electrode drive device which is connected to the scanning electrode group and outputs a scanning waveform having a select voltage level Vss and a non-select voltage level Vsn and a data electrode drive device which is connected to the data electrode group and outputs a data waveform, this is a liquid crystal display system which has the characteristic of being provided with a voltage level control means in which the data waveform takes any of the select voltage level Vds, the non-select voltage level Vdn or the intermediate voltage level Vdm, which is a voltage level between select voltage level Vds and non-select voltage level Vdn, and which sets the data waveform at the intermediate voltage level Vdm for a specified period at least either at the beginning or the end of the scanning period, every scanning period, which is the output period for the minimum unit display information which determines the liquid crystal display state, and also sets the intermediate voltage level Vdm so that it differs for a select pixel and for a non-select pixel.

When using this invention, the first aspect of the invention takes note that the cause of display non-uniformity is related to the fact that there is polarity inversion of the output voltage level of the pulse wave of the data electrode drive unit with regard to non-select voltage level Vsn of the pulse wave of the scanning electrode drive unit. This mode makes the output voltage level of the data electrode drive unit a lower level value than voltage level Vdm between its select voltage level Vds and non-select voltage level Vdn, that is to say its peak values, for a specified time (for instance, a 10-clock interval) every scanning period, which is the output period of the minimum unit of display information which determines the liquid crystal display state, disregarding the polarity inversion. Thus, this mode prevents display non-uniformity by making the influence of the distortion of the driving waveforms due to inversion and the ratio of the frequency components of the driving waveforms approximately constant without regard to the display pattern.

Figure 3:
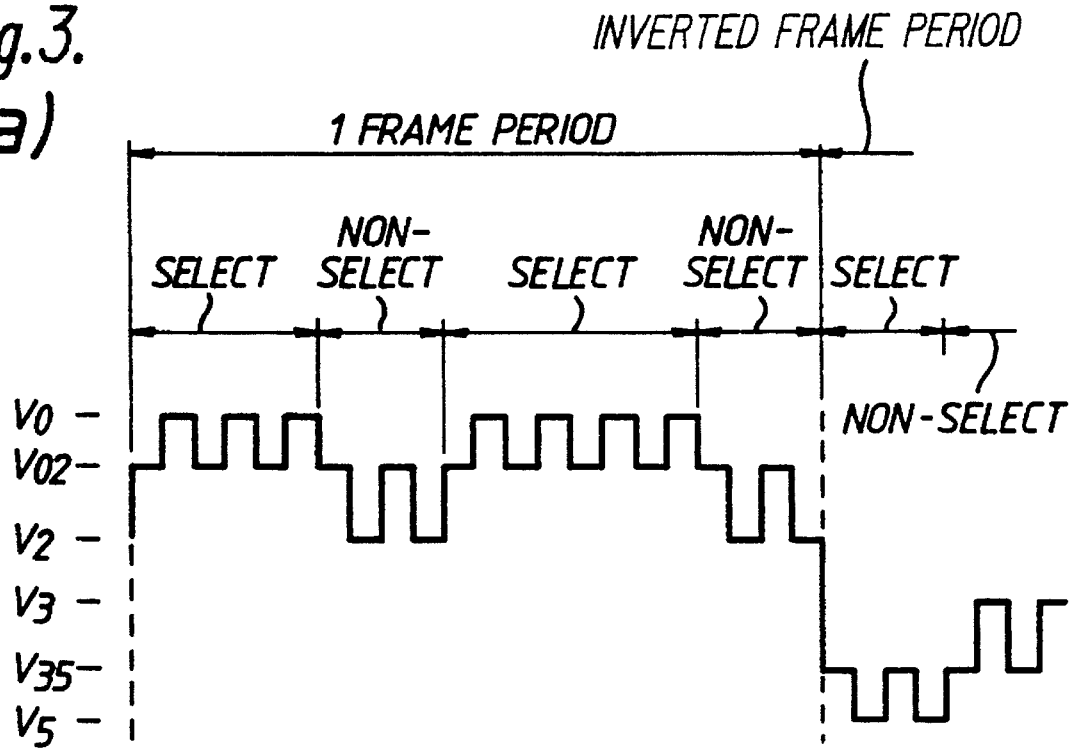
FIG. 3 is a waveform diagram to illustrate the operation of the first aspect in the invention.
Figure 3:
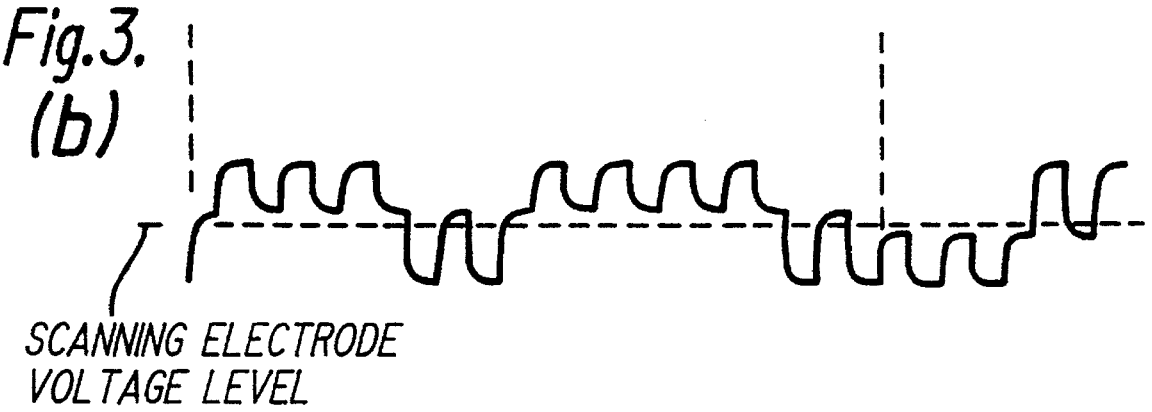
Figure 27:
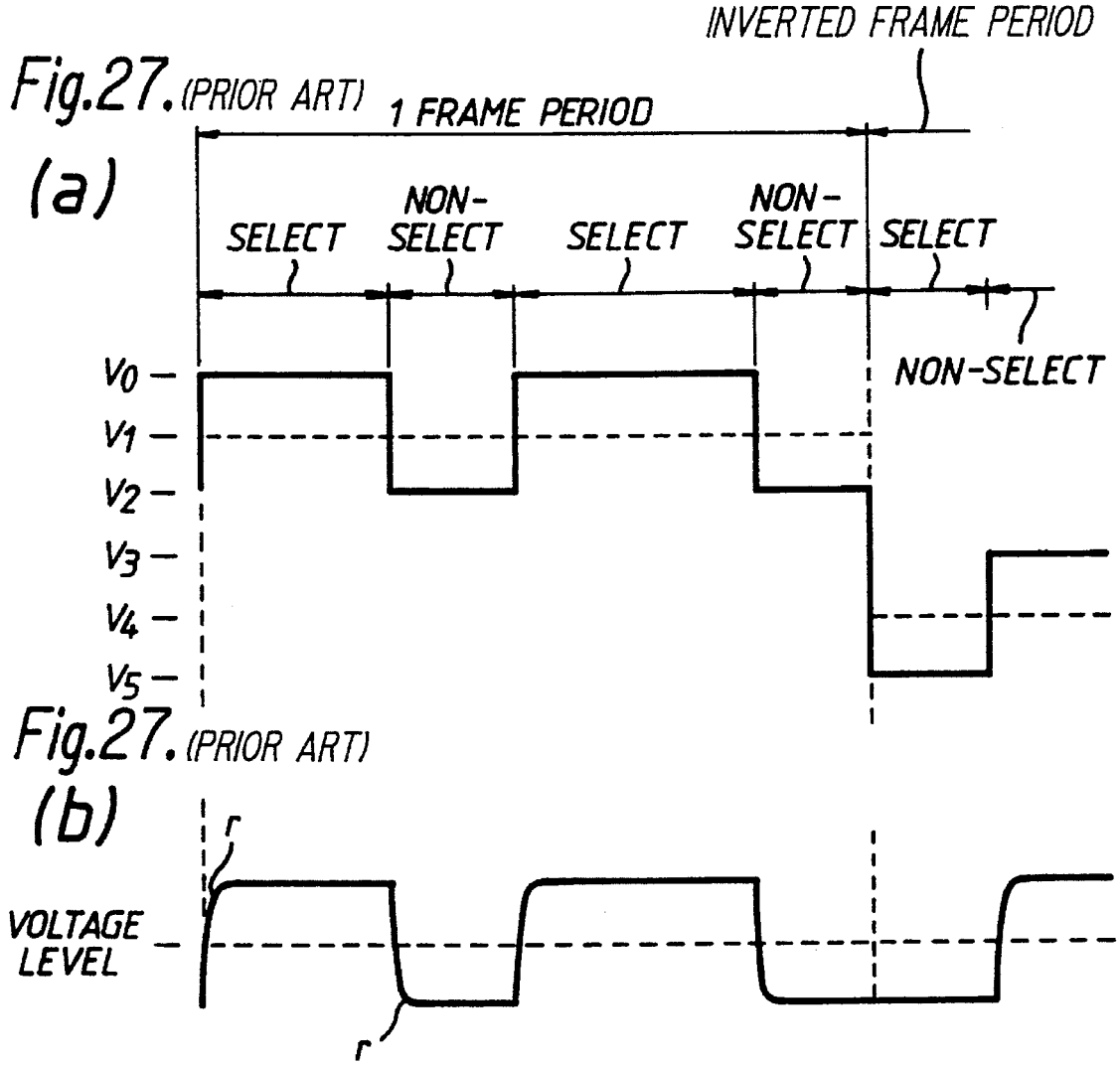
Fig.27. (PRIOR ART)
FIG. 27 is a waveform diagram to illustrate prior art.

FIG. 3(*a*) and (*b*) show a comparison of an example of the data waveforms due to this invention compared with the prior art waveforms of FIG. 27(*a*) and (*b*).

For instance, the first half of the specified time (for instance, a 10-clock interval) of the output waveform makes the output voltage level of the data electrode drive unit voltage level Vdm (V02 or V35) between select voltage level Vds (V0 or V5) and non-select voltage level Vdn (V2 or V3), every scanning period. In this case, the waveform applied to the liquid crystal pixel is subject to distortion every time the voltage level changes. Therefore, even if there is polarity inversion, there is hardly any change in the degree of waveform distortion. Also, since the frequency component of the driving waveform becomes a constant which does not depend on the display pattern, display non-uniformity which depends on the display pattern can be prevented.

On the other hand, the scanning waveform is generally constant and does not depend on the display pattern. However, this results in a large voltage being applied to the liquid crystal during the period taken by the select voltage level. For this reason, when the period in which the scanning waveform takes the select voltage level is made narrower in the same way as in the case of the data waveform, the RMS voltage applied to the liquid crystal greatly reduces and leads to an increase of the driving voltage of the liquid crystal display system. In order to accommodate this, some device such as the use of a liquid crystal with a large dielectric anisotropy must by employed in order to reduce the threshold voltage of the liquid crystal. However, when a liquid crystal with a large dielectric anisotropy is used, this causes the occurrence of display non-uniformity dependent on the display pattern. Also, even when the scanning waveform switches between the non-select voltage level and the select voltage level, distortion of the waveform occurs as a result. The nearer a pixel is to the output terminal of the scanning electrode drive unit, the smaller this waveform distortion becomes, and the further away a pixel is, the greater the distortion. For this reason, in a prior art liquid crystal display system, display non-uniformity occurred because the nearer a pixel was to the output terminal of the scanning electrode drive unit, the greater was the RMS voltage applied.

Furthermore, the first aspect of the invention makes the period in which the scanning waveform takes the select voltage level longer than the period in which the data waveform takes the select voltage level or the non-select voltage level every scanning period. In this way, this mode makes the superimposition of the period in which the waveform is subject to distortion when the scanning waveform switches between the non-select voltage level and the select voltage level and the period in which the data waveform takes the non-select voltage level or the select voltage level which relates to the display information smaller. Thus, this mode reduces the display non-uniformity which occurs due to the applied RMS voltage increasing the nearer a pixel is to the output terminal of the scanning electrode drive unit.

Figure 4:
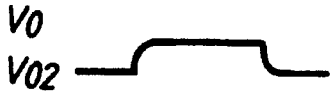
FIG. 4 is a waveform diagram to illustrate the operation of the first aspect in the invention.
Figure 4:
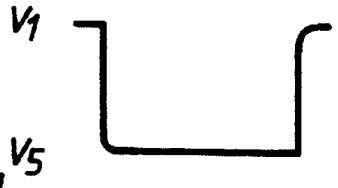
Figure 4:
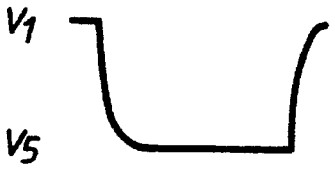
Figure 4:
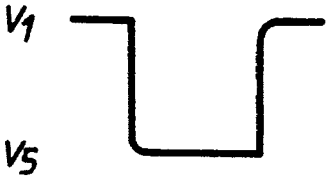
Figure 4:
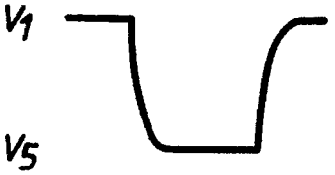
Figure 4:
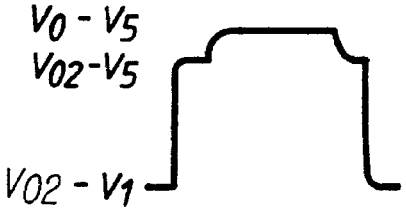
Figure 4:
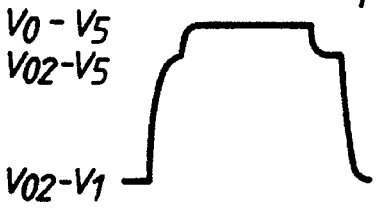
Figure 4:
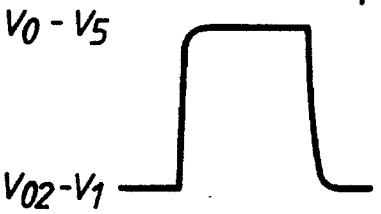
Figure 4:
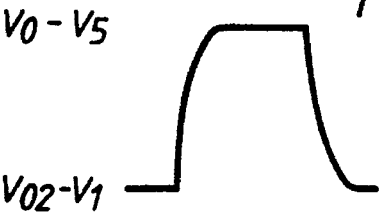

These states are shown in FIG. 4(*a*) to (*i*). (*a*) shows the state in which the data waveform is transmitted to the data electrodes, and (*b*) to (*e*) show the states in which the scanning waveform is transmitted to the scanning electrodes. (*f*) to (*i*) show the composite waveforms of (*b*) to (*e*) with (*a*), and these composite waveforms are actually applied to the liquid crystals. As shown in (*b*) and (*d*), the waveform distortion of the scanning waveform at the scanning electrode is small close to the output terminal of the scanning electrode drive unit but, as it moves further away from the output terminal of the scanning electrode, the distortion occurring in the rising and the falling of the waveform becomes greater, as shown in (*c*) and (*e*).

When the period in which the scanning waveform takes select voltage level V5 is longer than the period in which the data waveform takes the select voltage level or the non-select voltage level every scanning period, as shown in (*b*) and (*c*) the corresponding composite waveforms (*f*) and the width of the period in which the voltage is the greatest V0–V5 level hardly varies. Because of this, while there is also no great difference in the RMS voltages applied to the liquid crystals, when the period in which the scanning waveform takes the select voltage level V5 is not long, as in (*d*) and (*e*), the widths of the periods in which the corresponding composite waveforms (*h*) and (*i*) are V0–V5 differ. Therefore, a great difference occurs in the RMS voltages applied to the liquid crystals, and thus display non-uniformity will arise.

Moreover, by lengthening the period in which the scanning waveform takes the select voltage level in this way, increases in the driving voltage of the liquid crystal display system can also be prevented.

In the first aspect of the invention, the voltage level of the data waveform was made to be a voltage level Vdm between select the voltage level Vds and the non-select voltage level Vdn every scanning period. However, in the second aspect of the invention, at least one of switching from the select voltage level Vss to the non-select voltage level Vsn or switching from the non-select voltage level Vsn to the select voltage level Vss of the scanning waveform is carried out stepping through intermediate voltage level Vsm. When this type of stepped voltage switching is carried out, the voltage variation is gentle and the influence of waveform distortion becomes smaller. Therefore, display non-uniformity due to the distortion of the waveform becoming greater as it moves further from the output terminal of the scanning electrode drive unit can be prevented. Also, the third aspect of the invention is devised in such a way that the same effect as in the first aspect is obtained by setting the voltage level of the data waveform to a voltage level Vdm between the select voltage level Vds and the non-select voltage level Vdn for a specified period at least at the beginning or the end of the scanning period every scanning period, in the second aspect of the invention. It is also devised to make the ratio of the RMS voltage applied to a pixel in the ON state and the RMS voltage applied to a pixel in the OFF state become larger, that is to say, so that greater contrast can be obtained.

Figure 5:
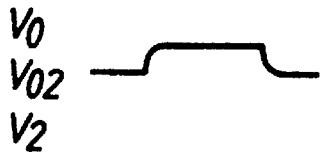
FIG. 5 is a waveform diagram to illustrate the operation of the second and third aspects in the invention.
Figure 5:
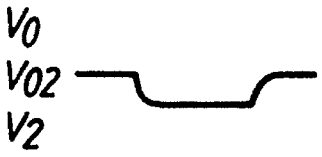
Figure 5:
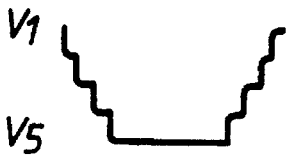
Figure 5:
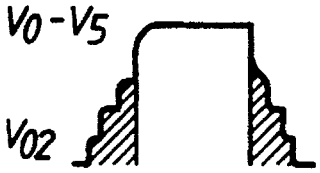
Figure 5:
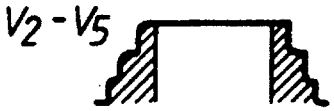
Figure 5:
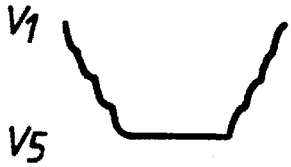
Figure 5:
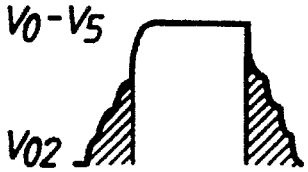
Figure 5:
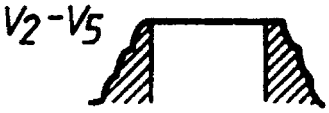
Figure 5:
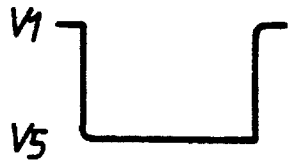
Figure 5:
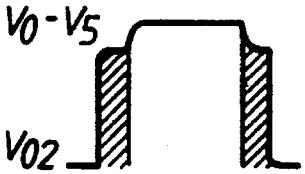
Figure 5:
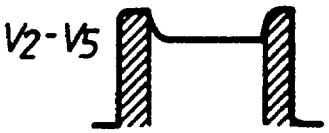
Figure 5:
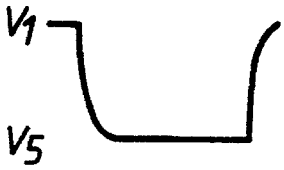
Figure 5:
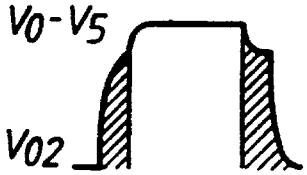
Figure 5:
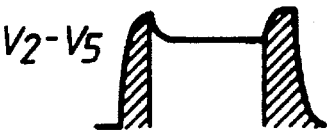

This operation is explained using FIG. 5. In this FIG., (*a*) and (*b*) respectively show the states in which the ON waveform and the OFF waveform of the data waveform are transmitted through the data electrodes, and (*c*) and (*f*) show the states in which the scanning waveform is transmitted through the scanning electrodes. (*g*) and (*n*) show respectively the composite waveforms of (*c*) to (*f*) with (*a*) and (*b*), and it is these composite waveforms which are actually applied to the liquid crystals.

In the above-mentioned first aspect of the invention, as shown in (*e*) and (*f*) as examples, even in the period in which the data waveform takes a voltage level between the select voltage level and the non-select voltage level every scanning period, the scanning waveform takes the select voltage level. However, at this time, as shown by the shading in drawings (*i*), (*m*), (*j*) and (*n*), the difference of the voltage level between the select voltage level and the non-select voltage level of the data waveform and the select voltage level of the scanning waveform is applied equally both to pixels in the ON state and pixels in the OFF state.

For this reason, this aspect is effective in preventing an increase of the driving voltage of the liquid crystal display system and in the reduction of display non-uniformity. However, the ratio of the RMS voltage applied to a pixel in the ON state and the RMS voltage applied to a pixel in the OFF state becomes slightly smaller.

As opposed to this, the third aspect of the invention uses the fact that the gentler the change of voltage, the smaller the effect of waveform distortion. By carrying out stepped switching between the select voltage level and the non-select voltage level of the scanning waveform, the voltages in the parts shown by the shading in (*g*), (*k*), (*h*) and (*i*) are kept low, while effectively reducing the effect of waveform distortion. By this means, this mode is designed to reduce display non-uniformity by making the ratio of the RMS voltage applied to a pixel in the ON state and the RMS voltage applied to a pixel in the OFF state larger, without impairing the contrast.

Besides the above-mentioned as a cause of display non-uniformity which depends on the display pattern, there is also display non-uniformity Which is due to changes in the electrostatic capacity of the liquid crystal display panel which accompany the ON/OFF switching of the pixels.

The fourth and fifth aspect of the inventions are designed to prevent this type of display non-uniformity. This display non-uniformity occurs, as shown in FIG. 6, due to the difference in the size of the driving waveform caused by the fact that the electrostatic capacity of the liquid crystal display pane differs depending on whether the liquid crystals are in the ON state or the OFF state. For this reason, when attention is paid to the data electrodes, the more the data electrodes for which pixels are in the ON state, the greater is the distortion of driving waveform and the lower is the RMS voltage applied to the liquid crystals. This fluctuation of the electrostatic capacity of the liquid crystal display panel accompanying ON/OFF switching is an unavoidable from the point of view of the operating principle in general liquid crystal display panels. If the threshold value of the liquid crystal is reduced with the aim of high multiplex driving by reducing the driving voltage of the liquid crystal display system and increasing the display capacity, the variation of the electrostatic capacity of the liquid crystal display panel accompanying ON/OFF switching should also be increased. Therefore, the display non-uniformity caused by the change of electrostatic capacity of the liquid crystal display panel accompanying ON/OFF switching becomes conspicuous. Also, in the drive method described above in which the data waveform takes the intermediate voltage level Vdm every scanning period, since the driving waveform is subject to distortion every scanning period, there is a tendency for this type of display non-uniformity readily to occur.

In the fourth aspect of the invention, the fact that, the more select voltage levels the data waveform taken, the greater the distortion of the pulse waveform and the greater the reduction of the RMS voltage applied to the liquid crystals, was taken into consideration. Therefore, display non-uniformity is prevented by superimposing a voltage c, which compensates for the reduction in the RMS voltage, on the select voltage level of the data waveform from the outset, both on waveforms with many select voltage levels for every line, as shown on FIG. 7(*a*), and on waveforms with few select voltage levels for every line, as shown in FIG. 7(*b*). That is to say, this structural mode is designed so that, when the select voltage levels Vds of respective inverted data waveforms are taken as V0 and V5 and the non-select voltage levels Vdn as V2 and V3, and the select voltage levels Vss of respective inverted scanning waveforms are taken as V0 and V5 and the non-select voltage levels Vsn as V1 and V4, the respective voltage levels are in the relationship $$V0>V1>V2>V3>V4>V5$$

and also the relationship $$(V0-V1)+(V4-V5)>(V1-V2)+(V3-V4)$$

is established. By this means, the more the data waveform takes the select voltage level Vds, the higher the RMS voltage applied between the output terminal of the data electrode drive unit and the output terminal of the scanning electrode drive unit. Thus, the difference of the waveform distortion is compensated by the fact that electrostatic capacity of the liquid crystal display panel differs.

Also, in the fifth aspect of the invention, the design is that when the select voltage levels Vds of respective inverted data waveforms are taken as V0 and V5, the non-select voltage levels Vdn as V2 and V3 and the intermediate voltage levels Vdm as V02 and V35, and the select voltage levels Vss of respective inverted scanning waveform are taken as V0 and V5 and the non-select voltage levels Vsn as V1 and V4, the relationship $$V0>V02>V1>V2>V3>V4>V35>V5$$

is established between the respective voltage levels.

As can be seen from the comparison of the shaded portions of FIG. 8(*a*) and (*b*), when the data waveform takes the select voltage level, the waveform distortion of the falling acts in the direction in which the RMS voltage applied to the liquid crystal increases. As opposed to this, when the data waveform takes the non-select voltage level, the wavefrom distortion of the falling acts in the direction in which the RMS voltage applied to the liquid crystal reduces. Thus, the difference of the waveform distortion is compensated by the fact that the electrostatic capacity of the liquid crystal display panel differs, and display non-uniformity caused by variation of the electrostatic capacity of the liquid crystal display panel which accompanies ON/OFF switching is prevented.

Incidentally, in the above fourth and fifth aspect of the inventions, the optimum values of individual voltage levels differ depending on the structural mode of the liquid crystal display panel which they are designed to drive. However, suitable settings may be made case by case. At this time, from the viewpoint of preventing deterioration of the liquid crystal, it is desirable to make the settings in such a way that (V0, V02, V1, V2) and (V5, V35, V4, V3) respectively correspond to each other, taking the mean voltage level between V2 and V3 as the center, and to set the voltage levels so that the direct current component applied to the liquid crystal is as small as possible.

However, apart from the above-mentioned waveform distortion, the voltage level fluctuates depending on the influence of waveforms applied to the liquid crystals of the surrounding pixels, and this causes display non-uniformity of the liquid crystal display system. The degree of this type of waveform distortion and voltage level fluctuation is expressed by the product of the resistance of the data electrodes and scanning electrodes, the electrostatic capacity of the liquid crystals and (a time constant).

In the sixth aspect of the invention, switching to a voltage level between the select voltage level and the non-select voltage level, which is carried out on the data waveform every scanning period as in the first aspect, does not depend on a square wave pulse. It is carried out in this mode by a waveform which has a delay time.

Figure 12:
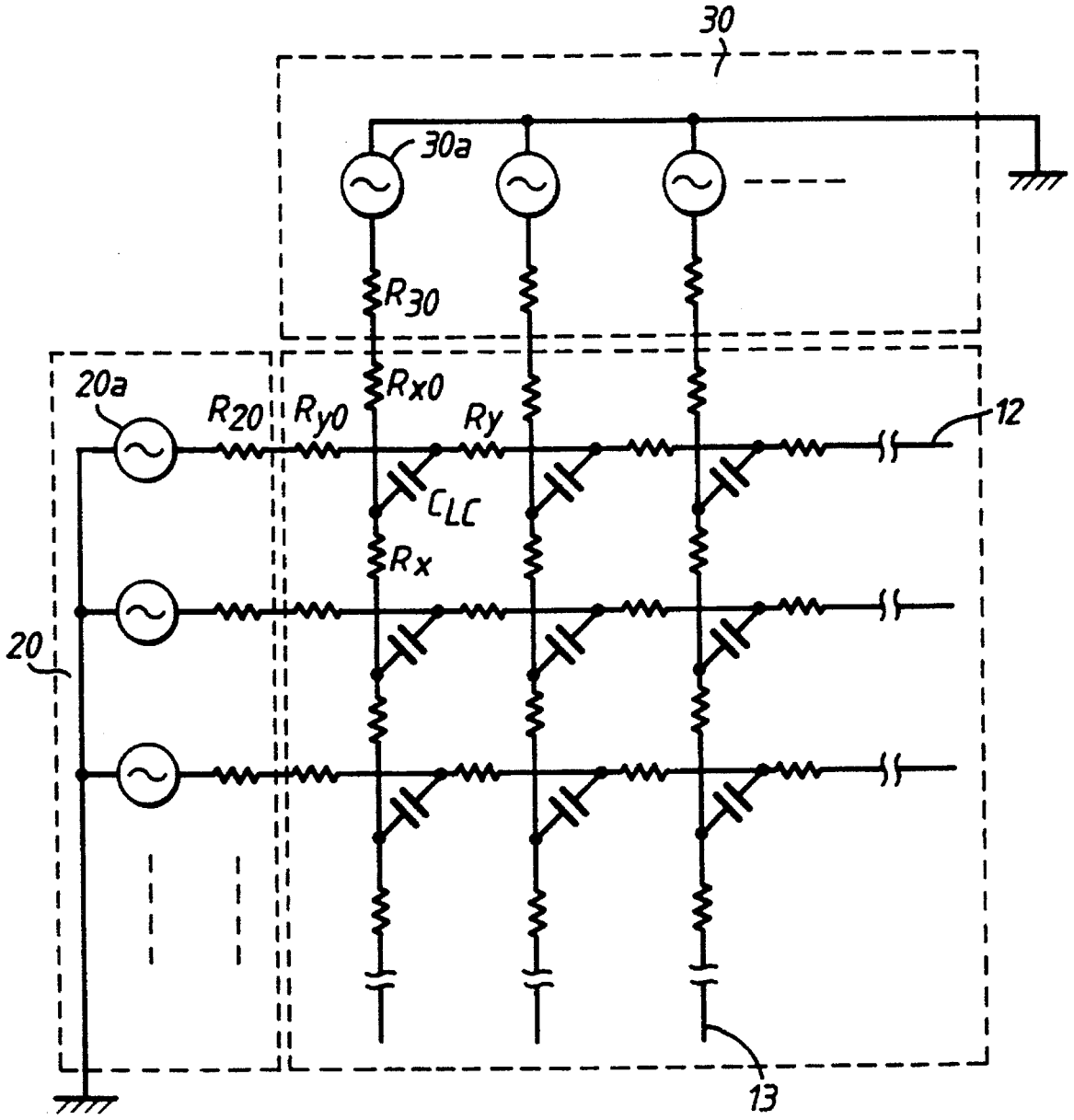
FIG. 12 is an equivalent circuit diagram to illustrate the sixth and eighth aspects in the invention.

FIG. 12 shows the drive circuit of a dot matrix type liquid crystal display system, which illustrates this invention, as an equivalent circuit. Liquid crystal display panel 10 has multiple scanning electrodes 12 aligned in parallel and multiple parallel rows of data electrodes 13 aligned arranged to cross these scanning electrodes. Liquid crystals are sandwiched between these electrodes, and an electrostatic capacity $C_{LC}$ is formed in the pixel at each point of intersection. Also, scanning electrodes 12 and data electrodes 13 respectively have resistances of Ry and Rx per pixel.

In scanning electrode drive device 20, a separate voltage source 20*a* is connected to each scanning electrode 12, and each has an output resistance R20. In the same way, the voltage sources 30*a* of data electrode drive device 30 are connected to each data electrode via output resistances R30. Also, this system has respective pull-out electrode resistances Ry0 and Rx0 from the output terminal units of scanning electrode drive device 20 and data electrode drive device 30 to the pixels.

Figure 13:
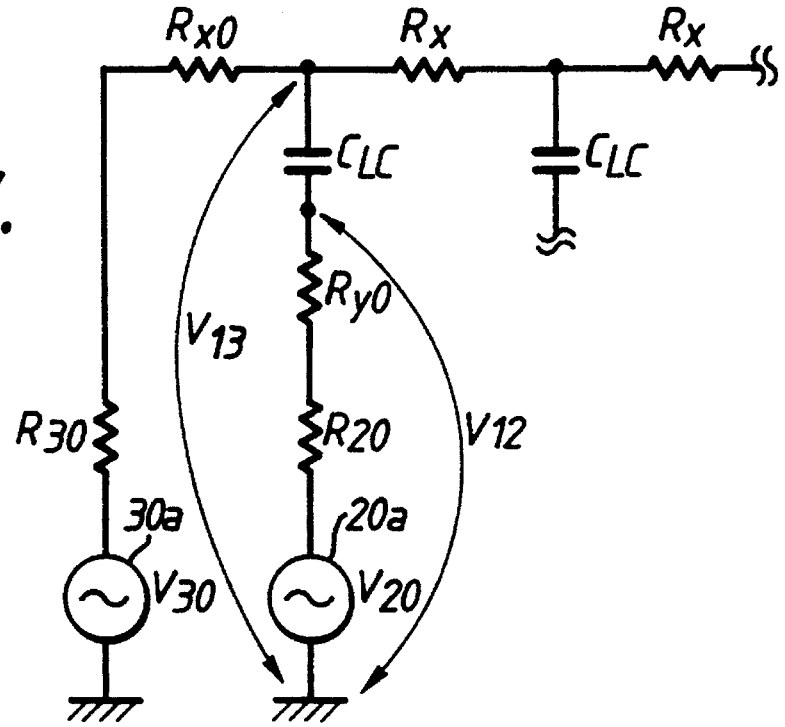
FIG. 13 is an equivalent circuit diagram and a waveform diagram to illustrate the operation of sixth and eighth aspects in the invention.
Figure 13:
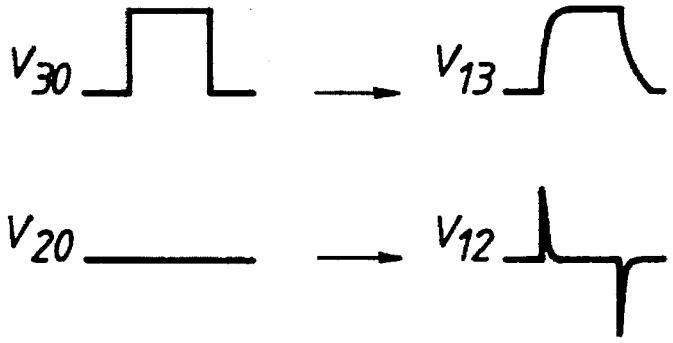
Figure 13:
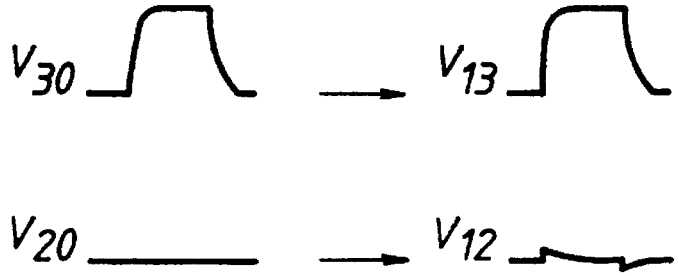

Here, FIG. 13 shows the equivalent circuit for only 1 electrode each of the scanning electrodes and the data electrodes.

From this equivalent circuit, the waveform of the voltage source of the data electrode drive device and the waveforms which appear at both the data electrode and the scanning electrode at this time can be considered.

FIG. 13(*a*) illustrates the relationships of voltage V30 of voltage source 30*a* of data electrode device 30 with voltage V13 which occurs at the data electrode and of voltage V20 of voltage source 20*a* of scanning electrode drive device 20 with voltage V12 which occurs at the scanning electrode. As shown in (*b*), in the case of voltage V30 of voltage source 30*a* of data electrode drive device 30 being a square wave, the low frequency component progresses toward the next pixel on the data electrode as a waveform which has distortion, and the high frequency component flows toward the scanning electrode via electrostatic capacity $C_{LC}$ of the pixel, and appears on the scanning electrode as a spike waveform. As shown in (*c*), in the case of voltage V30 having waveform distortion with delay times in the rising and falling of the square wave, the waveform which progresses to the data electrode takes a waveform with almost the same distortion, and also the presence of the spike waveform on the scanning electrode is not conspicuous.

The greater the electrostatic capacity C of the pixel, the greater the degree of this type of waveform distortion and spike waveform becomes, and also, the greater the resistance Rx of the data electrode, the greater it becomes.

From the above, in the case of a square wave, it can be seen that the difference of the number of output switchings of the data electrode drive device based on the display content of the screen readily causes the voltage applied to the liquid crystal to fluctuate. On the other hand, when the waveform of the voltage source of the data electrode drive device is made a waveform which has distortion given a delay time corresponding to the sizes of the electrostatic capacity $C_{LC}$ of the pixel and of the resistances Rx of the data electrode in the rising and falling portions of the square wave, the presence of waveform distortion occurring on the data electrode and the spike waveform on the scanning electrode become inconspicuous. Therefore, this shows that the difference in the number of output switchings of the data electrode drive device based on the display content of the image does not readily cause fluctuation of the voltage applied to the liquid crystal. Therefore, this proves that a uniform display can be obtained. Also, this reduces the display non-uniformity which depends on the distance from the output terminal and occurs due to the reduction of the RMS voltage applied to pixels distant from the output terminal, compared with pixels close to the output terminal of the electrode drive device.

In the same way, in the case when the voltage V20 of voltage source 20*a* of scanning electrode drive device 20 is also a square wave, the waveform is subject to distortion as the waveform progresses on the scanning electrode and, at the same time a spike waveform occurs on the date electrode.

The seventh aspect of the invention was derived from the same study on the output waveform of the scanning electrode drive device. This mode is devised so that a greater effect is obtained by making the stepped switching of the scanning waveform in the second aspect of the invention switching which has a rising or a falling with a continuous delay time.

Incidentally, in the sixth and seventh aspects, strictly speaking, the optimum values of the delay times of the output waveforms of the data electrode drive device and the scanning electrode drive device also vary due to the output resistances and the pull-out resistances of the data electrode drive device and the scanning electrode drive device. However, in a liquid crystal display device with a large information content, this can be determined depending on the electrostatic capacity $C_{LC}$ of the pixel and the sizes of the resistance Rx of the data electrode and the resistance Ry of the scanning electrode and the size of the display area. That is to say, the optimum value of the delay time of the output waveform of the data electrode drive device is determined by the electrostatic capacity C per data electrode and the resistance R per data electrode. For instance, in a liquid crystal display panel composed of M (data electrodes)×N (scanning electrodes), the electrostatic capacity C per data electrode is $$c=N\times C_{LC}$$

and the resistance R per data electrode is $$R=N\times Rx.$$

FIG. 14, shows a calculated example of the case when a liquid crystal display panel is connected to a data electrode drive device and a scanning electrode drive device, and all the pixels are taken as being in the non-selected state. It shows the relationship of the ratio V1/V0 to the ratio t/CR. V1/V0 is the ratio of the voltage V1 applied to the nearest pixel to the data electrode drive device and the voltage V0 applied to the furthest pixel from the data electrode drive device. t/CR is the ratio of the delay time t of voltage waveform at the output terminal of the data electrode drive device and the product CR of resistance R and electrostatic capacity C. Here, delay time t is defined as the time taken until the variation of the voltage is 1−exp(−1)=63% complete. It can be seen that, as t/CR becomes greater, V1/V0 increases and approaches 1, and the difference between V1 and V0 disappears. From this FIG., it can be said that the case in which the effect is obtained is when t/CR is roughly 0.3 or more. In practice, the electrostatic capacity C when the liquid crystal is in the ON state is almost twice that when the liquid crystal is in the OFF state. Therefore, in order to obtain the effect when the liquid crystal is in the ON state also, the liquid crystal may be set so that it becomes.

$$0.3\times CR\leqq t$$

for the electrostatic capacity C when, the liquid crystal is in the OFF state.

However, this does not mean that delay time t can be increased without limit. Unless it is set sufficiently smaller than the minimum pulse width Tp, the voltage applied the liquid crystal will reduce and will lead to an increase of the driving voltage. In practice, it is best to set this within limits in which it can stably be driven according to the voltage resistance of the driving circuit, such as the voltage drive unit.

Also, if delay time t varies greatly due to the variation of electrostatic capacity C of the liquid crystal display panel which accompanies the ON/OFF switching of the pixels, this will cause display non-uniformity. In a liquid crystal drive IC, which is the electrode drive device for a common liquid crystal display system, output impedance is the main resistance component. This has been the cause of display non-uniformity, since delay time t varies roughly proportionally to the variation of electrostatic capacity C of the liquid crystal display panel. Therefore, delay time t must not be increased too much in relation to delay time t0 of the waveform at the output terminal of the electrode drive device when the liquid crystal display panel is not in the connected state.

The relationship between delay times t and t0 in an electrode drive device of this invention is explained using the equivalent circuits in FIG. 15. (*a*) is an equivalent circuit showing the liquid crystal drive IC which is the electrode drive device of a common liquid crystal display system. (*b*) is the equivalent circuit diagram for an electrode drive device with a CR integrated circuit at the output terminal, as an example of an electrode drive device of this invention. In the Figure, R indicates the output resistance of the electrode drive device. C indicates the electrostatic capacity of the liquid crystal display panel and $C_0$ indicates the electrostatic capacity of the CR integrated circuit. Suppose that the waveform of the output terminal of the electrode drive device is studied with an oscilloscope OSC with a high-impedance probe when a square wave is outputted from the voltage source. In (*a*), as opposed to the waveform in the state when the liquid crystal display panel is not connected hardly being distorted, the waveform in the state when the liquid crystal display panel is connected has a distortion of delay time t=CR. On the other hand, in (*b*), the waveform of the output terminal in the state when the liquid crystal display panel is not connected has a distortion of delay time $t0=C_0R$, and the waveform in the state when the liquid crystal display panel is connected has a distortion of delay time $t=C_0R+CR$.

When electrostatic capacity C of the liquid crystal display panel varies according to the ON/OFF switching of the pixels, as opposed to the fact that, provided COR is made sufficiently greater than CR in (*b*), delay time t will always be a value close to t0 and will hardly vary, in (*a*), delay time t will also vary in proportion to C. That is to say, this means that, if delay time t of the waveform at the output terminal of the electrode drive device is roughly the same as delay time t0, even if the electrostatic capacity of the liquid crystal display panel varies, delay time t will not vary. Therefore, delay time t should be as close as possible to delay time t0. In practice, it is desirable to set delay time t so that it does not exceed twice delay time t0, that is to say so that it satisfies $$t\leqq 2\times t0.$$

The ninth aspect of the invention is a mode in which the data waveform in the first aspect is modified, so that a satisfactory effect can be obtained, even if the waveform distortion in the liquid crystal display panel is large.

Figure 17:
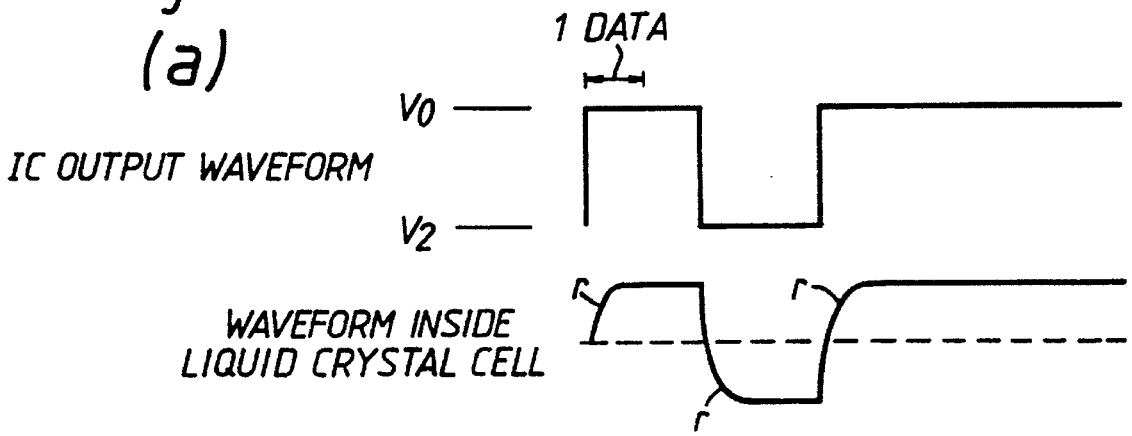
FIG. 17 is a waveform diagram to illustrate the ninth aspect in the invention.
Figure 17:
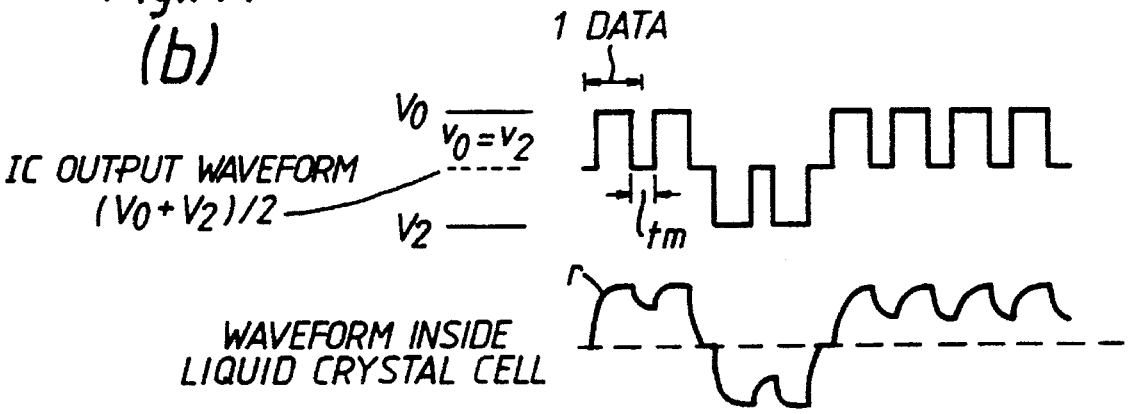
Figure 17:
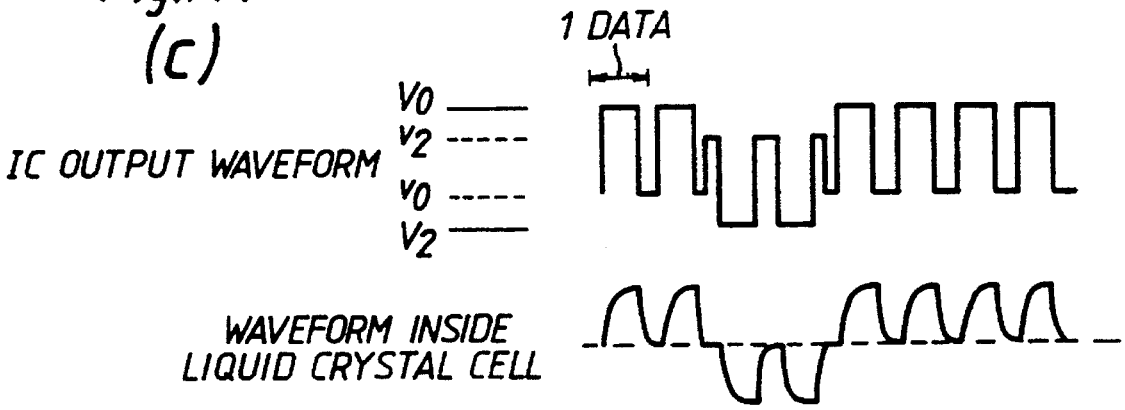

FIG. 17 shows a comparison of the data waveform of prior art and the data waveform of the ninth invention. (*a*) illustrates the prior art data waveform, (*b*) illustrates the data waveform in the first aspect and (*c*) illustrates the data waveform in the eighth aspect.

That is to say, in the waveform distortion r (rounding) in the prior art liquid crystal display panel shown in (*a*), by setting the period of intermediate voltage level V02 before and after each scanning period as shown in (*b*), distortion r occurs in the waveform of every line applied to the panel, and the RMS voltage approaches a constant value which does not depend on the display content. However, in the case of distortion r being greater than the width of the period of intermediate voltage level V02, as shown by the waveform in (*b*), the effect of the distortion cannot be sufficiently compensated by setting the intermediate voltage level before and after the V0 level and the intermediate voltage level before and after the V2 level to the same value. For this reason, although it is an effective method to make a separation between the pulses of each scanning period by sufficiently widening delay time tm of the intermediate voltage level, this will reduce the RMS of the select waveform at the same time.

In the eighth aspect of the invention shown in (c), for instance, intermediate voltage level V02 (V35 when inverted) is divided into two parts for select voltage level V0 and non-select voltage level V2 (V5 and V3 when inverted). A slight difference $\Delta V02=v_2-v_0$ ($\Delta V35=v_5-v_3$ when inverted) is provided to each part as $v_0$ and $v_2$ ($v_5$ and $v_3$ when inverted) respectively.

For this reason, an effect on display non-uniformity can also be obtained by shortening the time for the intermediate voltage level and inhibiting reduction of the contrast ratio. This is achieved by placing a time for the intermediate voltage level before and after each scanning period, and also setting the intermediate voltage level closer to the non-select voltage level than the mean value of the select voltage level and the non-select voltage level before and after select data, and setting it closer to the select voltage level than the same mean value before and after non-select data. In the above way, the difference of the effects of waveform distortion for polarity inversion and non-polarity inversion can be gradually reduced from FIG. 17(*a*) to (*c*). However, the difference $\Delta V02$ ($\Delta V35$ when inverted) of the intermediate voltage level for the select and non-select voltage levels has the reverse effect if it is made too great. Therefore, it is necessary suitably to adjust the difference according to the structural mode of the liquid crystal display panel which uses each intermediate voltage level.

Incidentally, apart from the case of executing normal drive for carrying out a binary display and the case of executing gray scale display using the so-called frame rate control method which varies the ratio of frames which write ON and frames which write OFF by making multiple frames as 1 cycle, this invention can also be applied for the execution of gray scale displays by the pulse-width modulation method, The pulse-width modulation method is a gray scale display method which executes gray scale display according to the ratio of the period in which the data waveform takes the select voltage level and the period in which it takes the non-select voltage level by splitting the data waveform which determines the display information per scanning line into multiple parts. When applying this invention, it is advisable to consider executing writing per line over continuous multiple scanning periods.

Embodiments of the first to fifth aspects of the invention are described below.

(Embodiment 1)

FIG. 1 is an aspect diagram of the liquid crystal display system of an embodiment of this invention. Scanning electrode drive unit 20, data electrode drive unit 30, power circuit 40 and voltage level control circuit 50 are connected to liquid crystal display panel 10. Liquid crystal display panel 10 consists of electrode groups in which a large number of fine lines of a transparent conductor made of indium-tin oxide are arranged in parallel on the respective facing surfaces of 2 glass substrates. The substrates are assembled so that a matrix is formed by the electrodes being orthogonal to each other in the length direction, and liquid crystal is sealed between the substrates. The electrode group which extends in the horizontal direction is scanning electrode group 12, the electrode group which extends in the vertical direction is data electrode group 13 pixels a11, a12, . . . , a21, a22, . . . are formed at the points of intersection.

The size of the cell substrates is A4, and the number of dots is 640×400. That is to say, the number of electrodes in scanning electrode group 12 is 400 and the number of electrodes in data electrode group 13 is 640. Each electrode is individually connected to scanning electrode drive unit 20 or to data electrode drive unit 30. In order to improve the drive margin by making the duty ratio from 1/400 to 1/200, data electrode group 13 is split into two at the center of the liquid crystal display panel, and upper and lower split drive is executed for 640×200 dots each by connecting data electrode drive unit 30 to the two ends of the liquid crystal display panel.

Power circuit 40 supplies various voltages to each electrode in accordance with the switching of the drive units. Its output terminals are connected to scanning electrode drive unit 20, data electrode drive unit 30 and voltage level control circuit 50.

Scanning electrode drive unit 20 is composed of shift register 21, frame inverter circuit 22 and drive circuit array 23. It outputs a pulse wave scanning waveform at the select voltage level to every line of scanning electrode in 1 frame cycle, and applies this to the scanning electrodes. While the voltage of the select voltage level (Vss) is being applied to one of the scanning electrodes, the rest of the electrodes are held at the non-select voltage level (Vsn).

At the same time, data electrode drive unit 30 is composed of shift register 31, latch circuit 32, frame inverter circuit 33 and drive circuit array 34. Data information inputted to shift register 31 is series/parallel converted via latch circuit 32, made into a pulse wave data waveform output via frame inverter circuit 33 and drive circuit array 34, and is simultaneously applied to each line of data electrode group 13. That is to say, when a pixel is made ON, it is made select voltage level (Vds), and when it is made OFF, it is made non-select voltage level (Vdn). By this means, when the scanning electrodes of the liquid crystal display panel are at the select voltage level (Vss), the pixels on the points of intersection at which the data electrodes are at the select voltage level (Vds) become in the ON state while the rest become in the OFF state.

Figure 2:
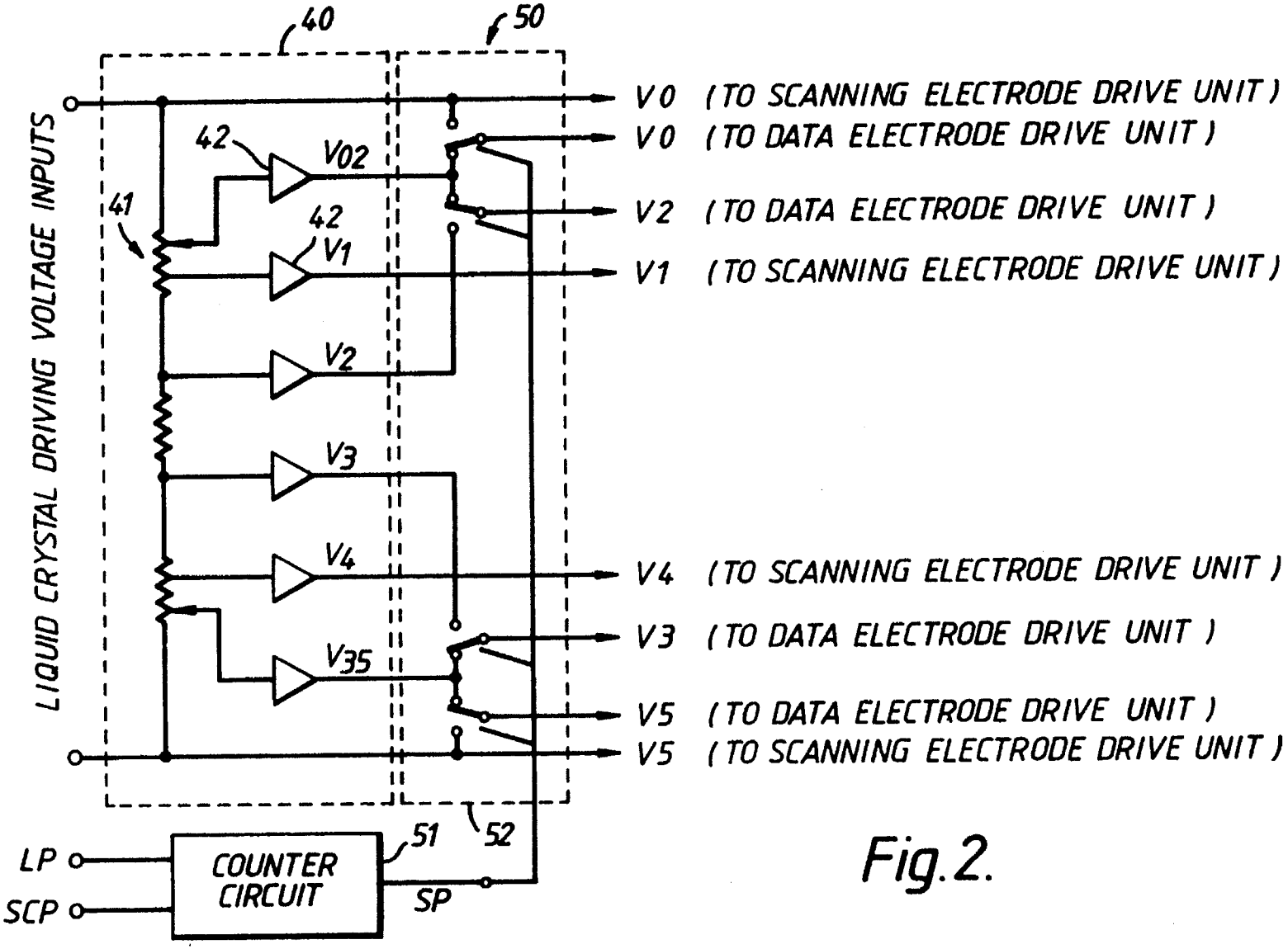
FIG. 2 is a diagram to illustrate the power circuit and the voltage level control circuit of the embodiment in FIG. 1.

FIG. 2 shows details of power circuit 40 and voltage level control circuit 50 of this embodiment. Power circuit 40 generates each voltage level V0, V02, V1, V2, V3, V4, V35, and V5 by potentiometer 41 and buffer 42, and these voltages take values in a descending order in which V0 is the highest and V5 is the lowest. V02 and V35 are adjustable.

Voltage level control circuit 50 is composed of counter circuit 51, which outputs switching pulse SP taking its timing by latch pulse. LP and clock pulse SCP, and switching circuit 52, which executes switching of the power voltage level by the switching pulse. As shown in FIG. 9, this operates so that the voltage level of the data waveform becomes voltage level Vdm, an intermediate voltage level, that is to say V02 (V35 when inverted), roughly midway between select voltage level Vds, that is to say the peak value V0 (V5 when inverted), and non-select voltage level Vdn, that is to say V2 (V3 when inverted), for a predetermined time during the first part of the data waveform in every scanning period, in this case during the first 10 clocks, taking 1 scanning period as 160 clocks.

That is to say, each data waveform only becomes both select voltage level V0 (V5 when inverted) and non-select voltage level V2 (V3 when inverted) during the latter part of the scanning period, and it takes voltage level V02 (V35 when inverted) between select voltage level V0 (V5 when inverted) and non-select voltage level V2 (V3 when inverted) in the first part.

At the same time, the scanning waveform is select voltage level Vss, that is to say a pulse waveform of peak value V5 (V0 when inverted) over the width of 1 scanning period. The pulse width of the data waveform every scanning period is smaller than the pulse width of the scanning waveform. This means that, during the data waveform pulse, it is connected by a voltage level between the above select voltage level and non-select voltage level.

That is to say, by this means, the waveform shown in FIG. 3(*a*) is outputted from the data electrode drive unit. When the scanning electrode voltage level is taken as the reference and the scanning electrode voltage level is as shown in FIG. 3(*b*), the waveform applied to each pixel at the electrode intersection points of the liquid crystal display panel becomes a waveform of similar form in which distortion has occurred every scanning period.

Although it is evident when this waveform is compared with the waveform of prior art in FIG. 27, since a voltage of roughly the same waveform is applied to the pixels of each lines, this shows that display non-uniformity will be eliminated or reduced. The reduction of RMS voltage of each electrode line can be compensated by increasing the peak value (crest value).

In this embodiment, the A4 size, 640×400 dot super-twist type liquid crystal display panel was driven by splitting it into upper and lower parts of 640×200 dots each. In this liquid crystal display panel, the threshold voltage of the liquid crystal is approximately 2.5 V, and the variation of the electrostatic capacity of the liquid crystal display panel accompanying ON/OFF switching is not very great. Scanning electrode drive unit 20 and data electrode drive unit 30 are respectively the T9822 and the T9821 produced by Toshiba Company, Limited, and these are connected to the liquid crystal display panel by the TAB system. In this case, the power source of scanning electrode drive unit 20 uses V0 of the power circuit as it stands. However, since the power source waveform inputted to data electrode drive unit 30 is modulated by the data voltage level control circuit, in order to prevent malfunction of the data electrode drive unit IC, the power source of the data electrode drive unit is supplied by a separate system from the liquid crystal drive power source, using DC +5 V.

When this liquid crystal display system was multiplex driven using the frame inversion method at duty ratio 1/200, bias ratio 1/14 and frame frequency 70 Hz, a uniform display with little display non-uniformity dependent on the display pattern was obtained. At this time, the contrast was 10:1.

Also, when the display was carried out by inputting 16 gray scale data using the frame culling method, in the same way as in the above case, a uniform display with little display non-uniformity dependent on the display pattern was obtained, and 14 gray scales could be discriminated.

(Embodiment 2)

Figure 10:
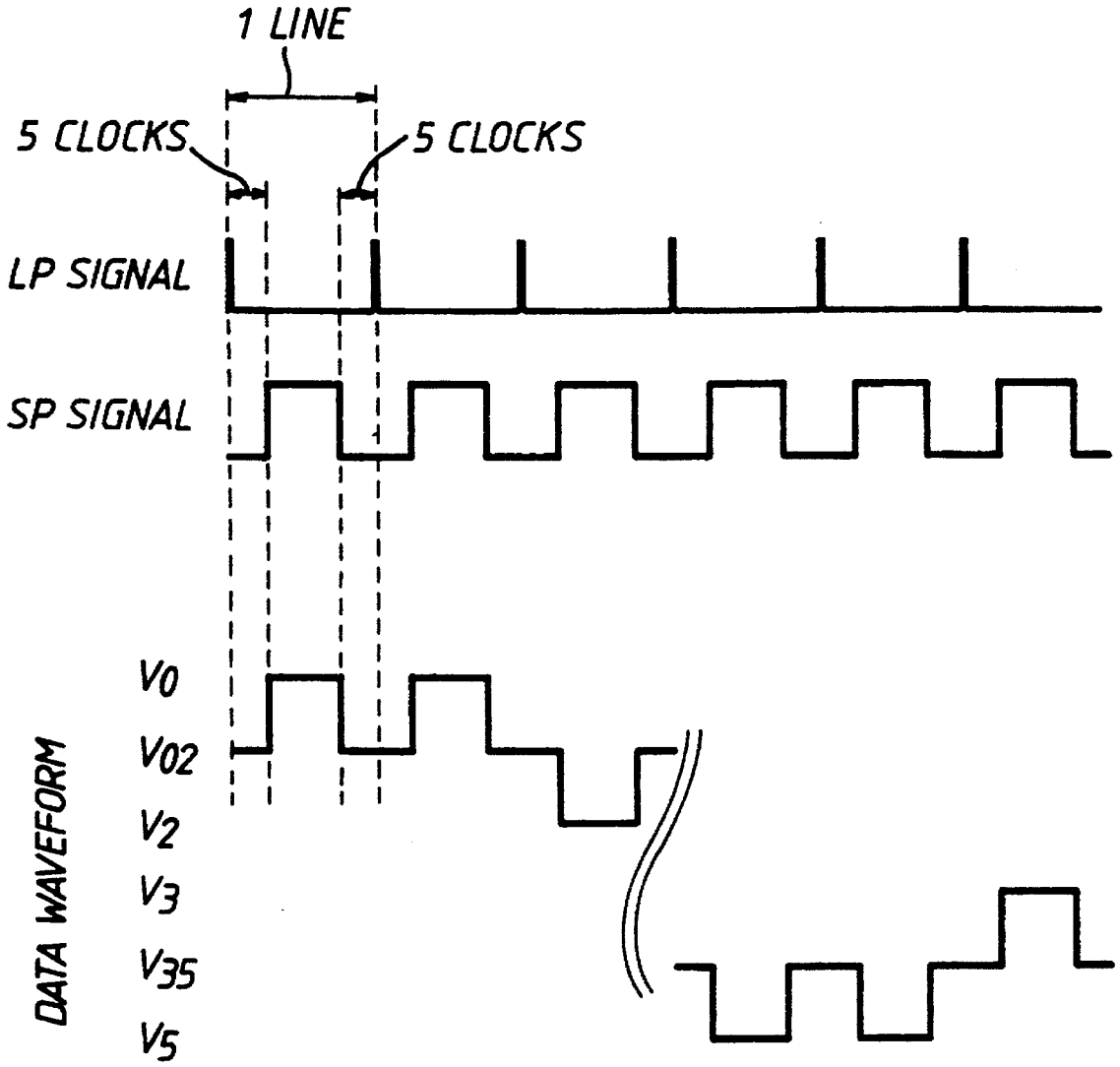
FIG. 10 is a waveform diagram to illustrate the operation of Embodiment 2 in the invention.

The way of taking the timing of the voltage level control circuit for the data waveform in Embodiment 1 was altered. As shown in FIG. 10, the data waveform output voltage level in the data electrode drive unit was operated so that it became voltage level V02 (or V35) roughly midway between select voltage level V0 (or V5) and non-select voltage level V2 (or V3) of the data electrode drive unit IC at both the beginning and the end of the scanning period (5 clocks each, taking one scanning period as 160 clocks). When the liquid crystal display system was driven, a uniform display with little display non-uniformity dependent on the display pattern was obtained, in the same way as in Embodiment 1.

(Embodiment 3)

The time taken by voltage level V02 (or V35) in Embodiment 2 was altered from 5 clocks each to 10 clocks each per scanning period. When the liquid crystal display system was driven taking the bias ratio as 1/13, although the optimum drive voltage level increased a little, the display non-uniformity depending on the display pattern became even less.

(Embodiment 4)

When the Liquid crystal display system in Embodiment 1 was driven by the combined use of the frame inversion method and the 13 line inversion method, a uniform display with little display non-uniformity dependent on the display pattern was obtained, in the same way as in Embodiment 1.

(Embodiment 5)

The operation of the voltage level control circuit applied to the data waveform in Embodiment 2 was also applied to the scanning waveform.

Figure 11:
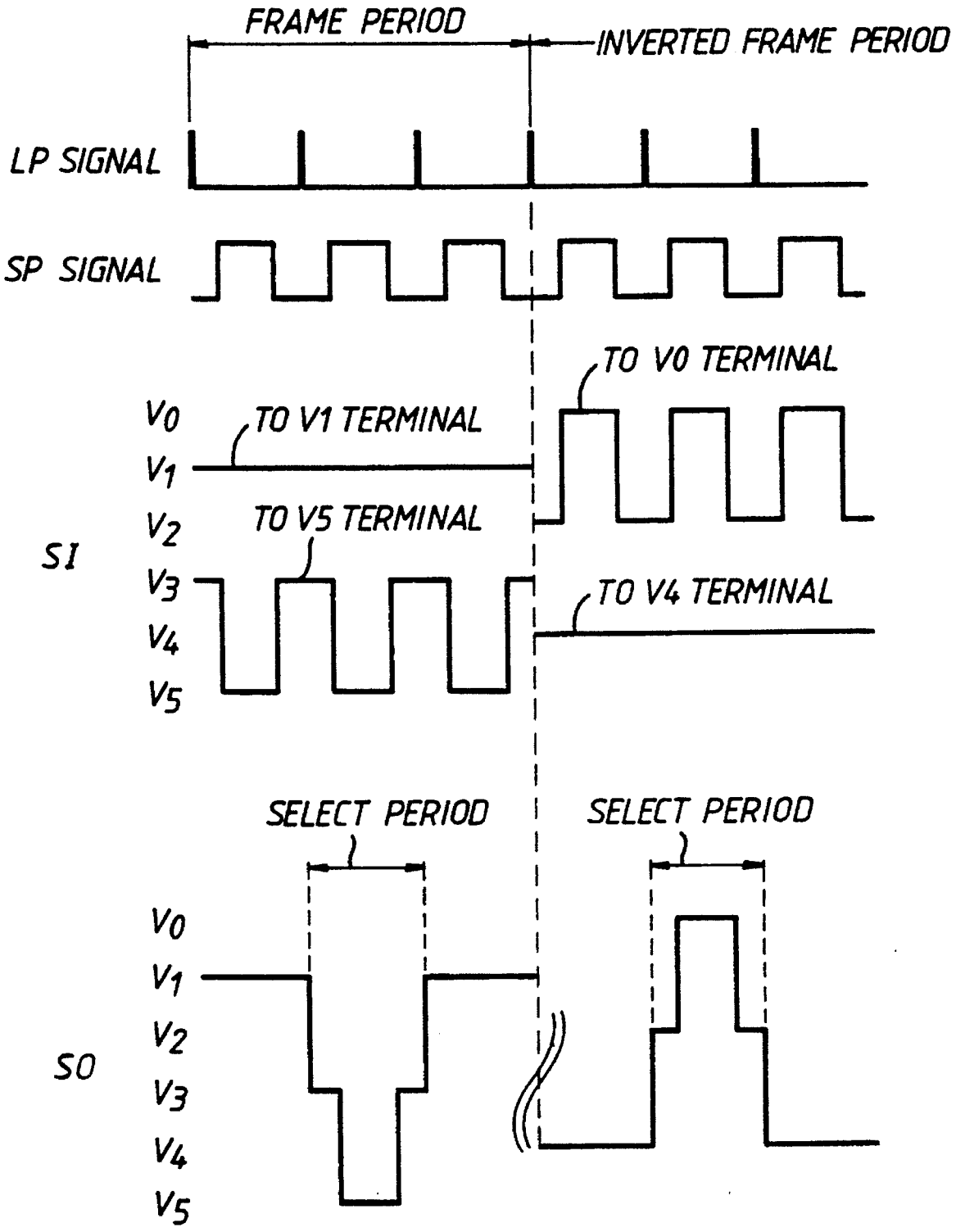
FIG. 11 is a waveform diagram to illustrate the operation of Embodiment 5 in the invention.

As shown in FIG. 11, in the same way as for the data pulse, a switching pulse SP was outputted, taking its timing by latch pulse LP and clock pulse SCP, and switching of the power source voltage level was carried out by this switching pulse. However, the system was operated so that every time the output of waveform SI, that is to say a one line portion, was carried out, non-select voltage level V3 (or V2) of the data electrode drive unit, which is a voltage level between the select voltage level V0 (or V5) and non-select voltage level V1 (or V4) of the scanning electrode drive unit, was inputted to the input terminal of the scanning electrode drive unit, during the first and last 5 clocks.

First, the same select voltage level V0 (or V5) and non-select voltage level V2 (or V3) as in the prior art driving method were inputted to the data electrode drive unit without passing through the voltage level control circuit, and a waveform generated by the voltage level control circuit was inputted only to the scanning electrode drive unit. By this means, the system was designed to carry out both switching from select voltage level V0 (or V5) to non-select voltage level V1 (or V4) and from non-select voltage level V1 (or V4) to select voltage level V0 (or V5) of the scanning waveform of the scanning electrode drive unit in steps via intermediate voltage level V3 (or V2). At this time, although there was display non-uniformity depending on the display pattern, a display with very little display non-uniformity dependent on the distance from the output terminal of the scanning electrode drive unit was obtained.

Next, the method was altered so that, as in Embodiment 2, the output waveform of the voltage level control circuit was also inputted to the data electrode drive unit.

At this time, voltage levels V02 and V35 between the select voltage levels and the non-select voltage levels taken by the output waveform 50 of the data electrode drive unit every scanning period were set so that they were respectively equal to the non-select voltage levels V1 and V4 of the scanning electrode drive unit. When this liquid crystal display system was driven using the frames inversion method, a uniform display with little display non-uniformity dependent on the display pattern was obtained in the same way as in Embodiment 1. Also, the contrast was improved over Embodiment 1 at 13:1.

(Embodiment 6)

When the liquid crystal display panel in Embodiment 5 was driven by altering the panel to one with a threshold voltage of approximately 1.9 V and a slightly larger electrostatic capacity variation of the liquid crystal display panel which accompanies ON/OFF switching, it was observed that, although the drive voltage could be reduced, the display non-uniformity dependent on the display pattern was slightly more than that in Embodiment 5.

(Embodiment 7)

When the panel in Embodiment 6 was adjusted and driven so that the non-select voltage level of scanning electrode drive unit 20 became $$(V0-V1)+(V4-V5)>(V1-V2)+(V3-V4)$$

a uniform display with less display non-uniformity dependent on the display pattern than in Embodiment 5 was obtained.

(Embodiment 8)

When the panel in Embodiment 7 was adjusted and driven so that select voltage levels V0 and V5 and non-select voltage levels V2 and V3 of the output waveform of the data electrode drive unit IC; the voltage levels V02 and V35 between the select voltage levels and the non-select voltage levels taken every line by the output waveform of the data electrode drive unit IC, and the select voltage levels V0 and V5 and the non-select voltage levels V1 and V4 of the output waveform of the scanning electrode drive unit became $$V0>V02>V1>V2>V3>V4>V35>V5$$

a uniform display with even less display non-uniformity dependent on the display pattern than in Embodiment 7 was obtained.

(Embodiment 9)

When the liquid crystal display panel in Embodiment 8 was driven by altering it to one with a threshold voltage of approximately 2.5 V and a slightly smaller electrostatic capacity variation of the liquid crystal display panel which accompanies ON/OFF switching, a uniform display with even less display non-uniformity dependent on the display pattern than in Embodiment 8 was obtained.

Also, when the display was carried out by inputting 16 gray scale data using the frame culling method, in the same way as in the above case, a uniform display with little display non-uniformity dependent on the display pattern was obtained, and all 16 gray scales could be discriminated.

(Comparative Example 1)

When the liquid crystal display panel in Embodiment 1 was driven using a prior art data electrode drive circuit which does not set a voltage level between the select voltage level and the non-select voltage level, a large amount of display non-uniformity dependent on the display pattern and display non-uniformity dependent on the distance from the output terminal of the scanning electrode drive unit to the pixel occurred, and a uniform display could not be obtained.

Also, when display was performed by inputting 16 gray scale date using the frame culling method, a large amount of display non-uniformity dependent on the display pattern occurred, and only 6 gray scales could be discriminated.

(Comparative Example 2)

When the liquid crystal display panel in Embodiment 1 was driven using a combination of the frame inversion method and the 13-line inversion method by using a prior art data electrode drive circuit, although the degree was better than in Comparative Example 1 above, still a large amount of display non-uniformity dependent on the display pattern and display non-uniformity dependent on the distance from the output terminal of the scanning electrode drive unit to the pixel occurred, and a uniform display could not be obtained.

Also, when display was performed by inputting 16 gray scale data using the frame culling method, a large amount of display non-uniformity dependent on the display pattern occurred, and only 8 gray scales could be discriminated.

Next, embodiments of the sixth to eighth invention structural modes are described.

(Embodiment 10)

A discrete data electrode drive unit 30 with a delay circuit 35 was produced and used so that the switching to a voltage level between the select voltage level (Vds) and the non-select voltage level (Vdn) which was carried out on the data waveform every scanning period in Embodiment 1 could be carried out on a waveform with a delay time which did not depend on a square wave pulse.

Figure 18:
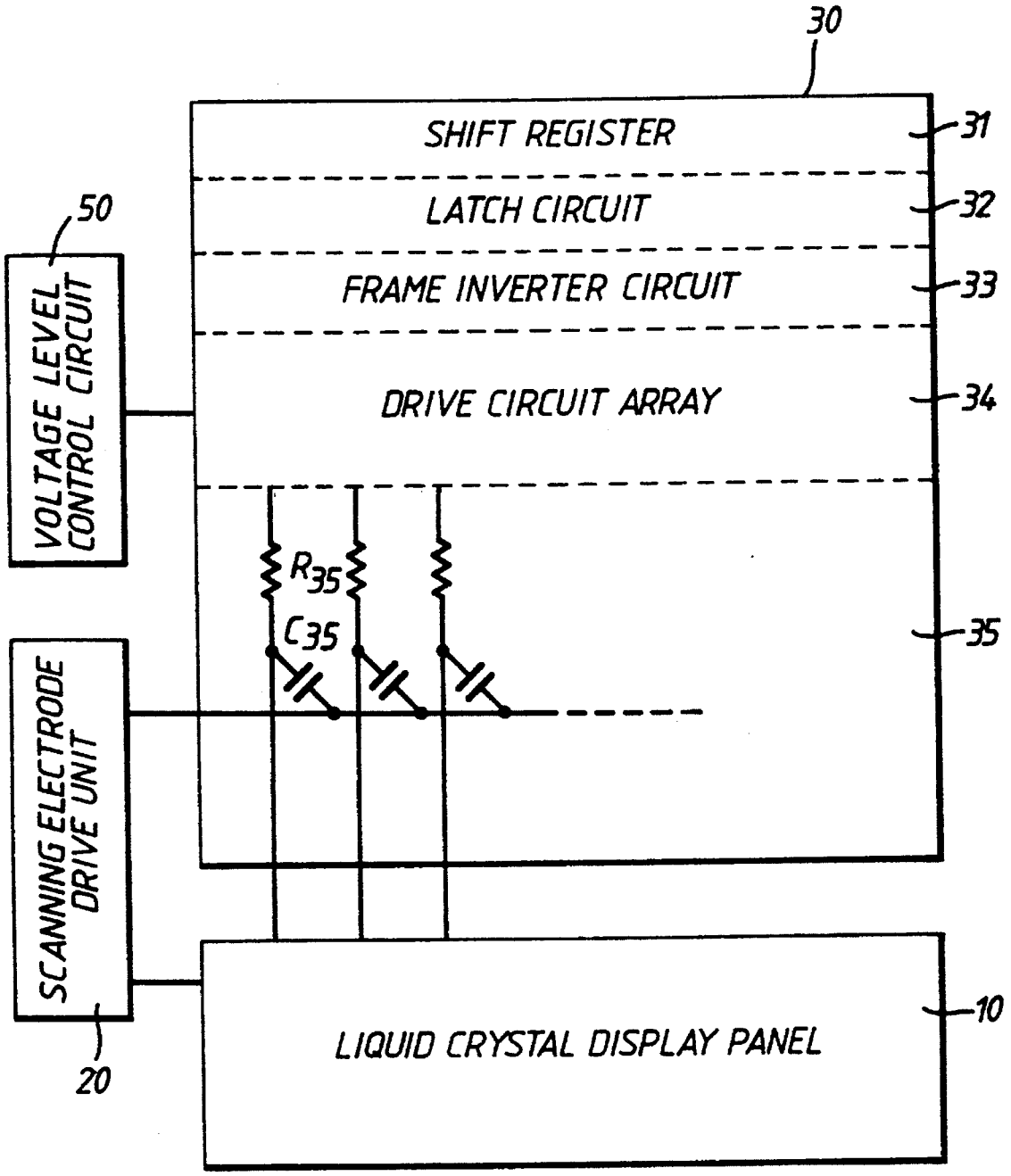
FIG. 18 is a diagram to illustrate the data electrode drive unit of Embodiment 10 in the invention.

FIG. 18 is a drawing to illustrate data electrode drive unit 30 of this embodiment. Data electrode drive unit 30 consists of shift register 31, latch circuit 32, frame inverter circuit 33, drive circuit array 34 and delay circuit 35 which is provided at the output terminal unit of drive circuit array 34. Delay circuit 35 consists of resistance R35 and electrostatic capacitor C35, and it is a CR integrated circuit which is connected to the non-select voltage level of the scanning electrode drive unit and operates via electrostatic capacitor C35. This data electrode drive unit 30 series/parallel converts data information introduced to shift register 31 via latch 32. It produces a square wave pulse such as the data waveform of Embodiment 1 via frame inverter circuit 33 and drive circuit array 34 and produces a waveform with a delay time via delay circuit 35, and simultaneously applies these to every line of data electrode group 13. Incidentally, the delay time is adjustable by altering the sizes of resistance R36 and electrostatic capacitor C35.

Figure 19:
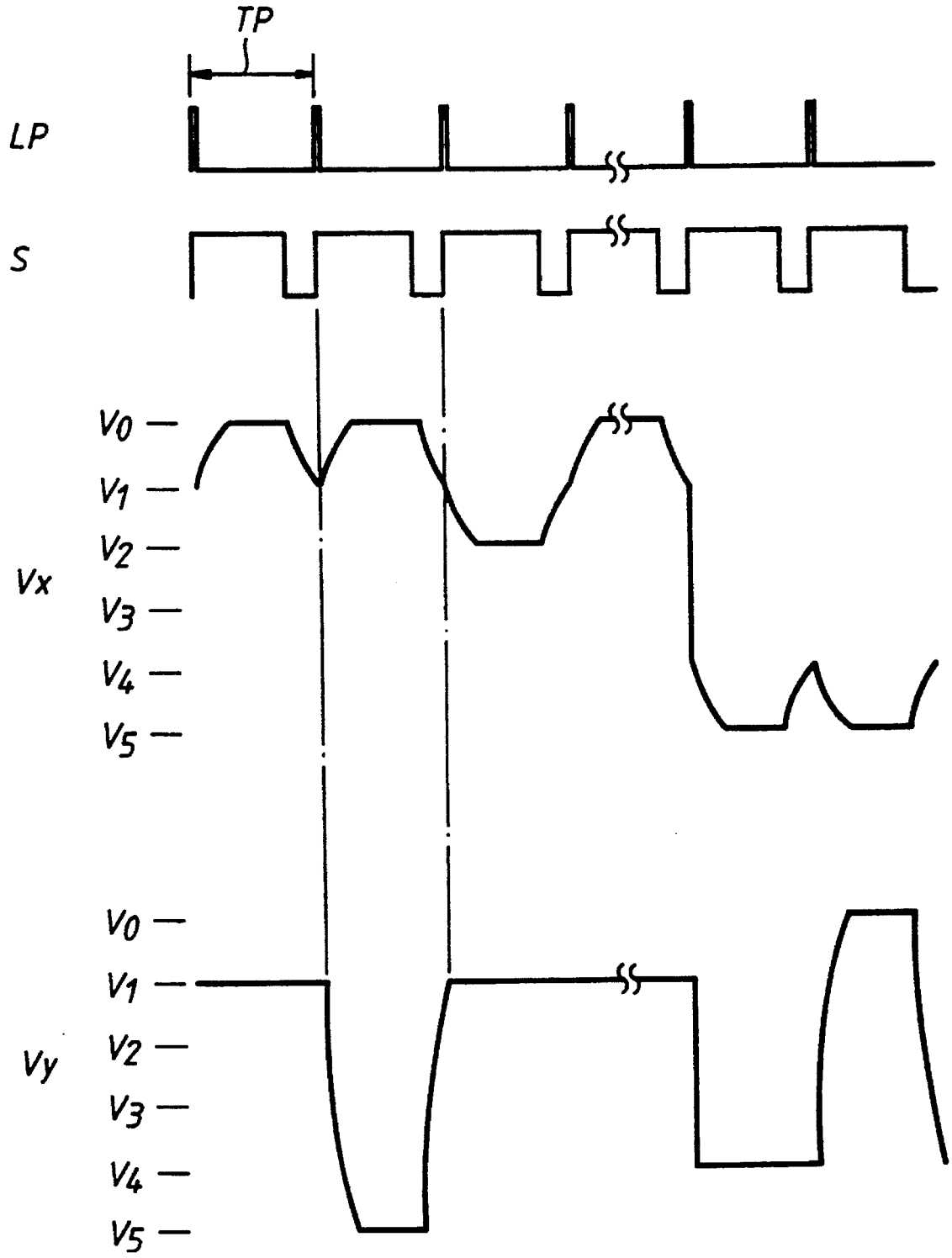
FIG. 19 is a diagram to illustrate Embodiments 10 and in the invention.

Also, the period for switching to voltage level V02 (or V35) was altered to the last 10 clocks per line, so that the waveform shown by Vx in FIG. 19 was outputted from data electrode drive unit 30.

The liquid crystal display panel used in this embodiment was the same as that in Embodiment 1. The electrostatic capacity $C_{LC}$ of the pixels in the OFF state was approximately 0.7 pF and the electrostatic capacity C pep data electrode line was approximately 140pF. Also, the resistance R of 1 data electrode line was 3.5 kΩ, and the time constant CR was 0.49 μs. At the same time, since the driving conditions were made frame frequency 70 Hz and duty ratio 1/200, the minimum pulse width was approximately 70 μs. Therefore, taking the delay time tx in the state with the liquid crystal display panel connected to data electrode drive unit 30 as a parameter, its relationship with the display quality was studied. The results are shown in FIG. 20. When tx was greater than 0.5 μs, tx/t0≦2, and a reduction of the display non-uniformity dependent on the display pattern was observed.

For example, when the delay time t0 in the state with the liquid crystal display panel not connected to data electrode drive unit 30 was 0.8 μs, delay time tx was 1 μs, and a uniform display with even less display non-uniformity dependent on the display pattern than in Embodiment 1 was obtained.

(Embodiment 11)

This was designed so that the waveform shown by Vy in FIG. 19 was outputted from the scanning electrode drive unit by applying the operation of the electrode drive unit which was applied to the data waveform in Embodiment 10 to the scanning waveform as well.

The electrostatic capacity C per scanning electrode line of the liquid crystal display panel used in this embodiment was approximately 420pF, the resistance R of 1 scanning electrode line was approximately 10 kΩ, and the time constant CR was 4.2 μs. At the same time, since the driving conditions were made frame frequency 70 Hz and duty ratio 1/200, the minimum pulse width was approximately 70 μs Therefore, first, in the same way as for the prior art liquid crystal display system, when the liquid crystal display panel was not connected to data electrode drive unit 30, the data electrode drive unit was made in a condition in which there was no delay in the data pulse waveform (delay time t0–0), and taking the delay time ty of the scanning waveform in the state with the liquid crystal display panel connected to electrode drive unit 20 as a parameter, its relationship with the display quality was studied. The results are shown in FIG. 21. When ty was greater than 1.25 μs, ty/CR≧0.3, and a reduction of the display non-uniformity dependent on the distance from the output terminal of the scanning electrode drive unit was observed.

For example, when the delay time t0 in the state with the liquid crystal display panel not connected to scanning electrode drive unit 20 was 3.55 μs, delay time ty was 4 μs, and, although there was display non-uniformity dependent on the display pattern, a display with extremely small display non-uniformity dependent on the distance from the output terminal of the scanning electrode drive unit was obtained.

Next, when this liquid crystal display system was driven by adjusting the delay time ty of the scanning waveform in the state with the liquid crystal display panel connected to scanning electrode drive unit 20 to 4 μs, and the delay tx of the data waveform in the state with the liquid crystal display panel connected to data electrode drive unit 30 to 1 μs, a uniform display with little display non-uniformity dependent on the display pattern was obtained in the same way as in Embodiment 10. Also, the display non-uniformity dependent on the distance from the output terminal of the scanning electrode drive unit was less than in Embodiment 10.

(Embodiment 12)

Figure 22:
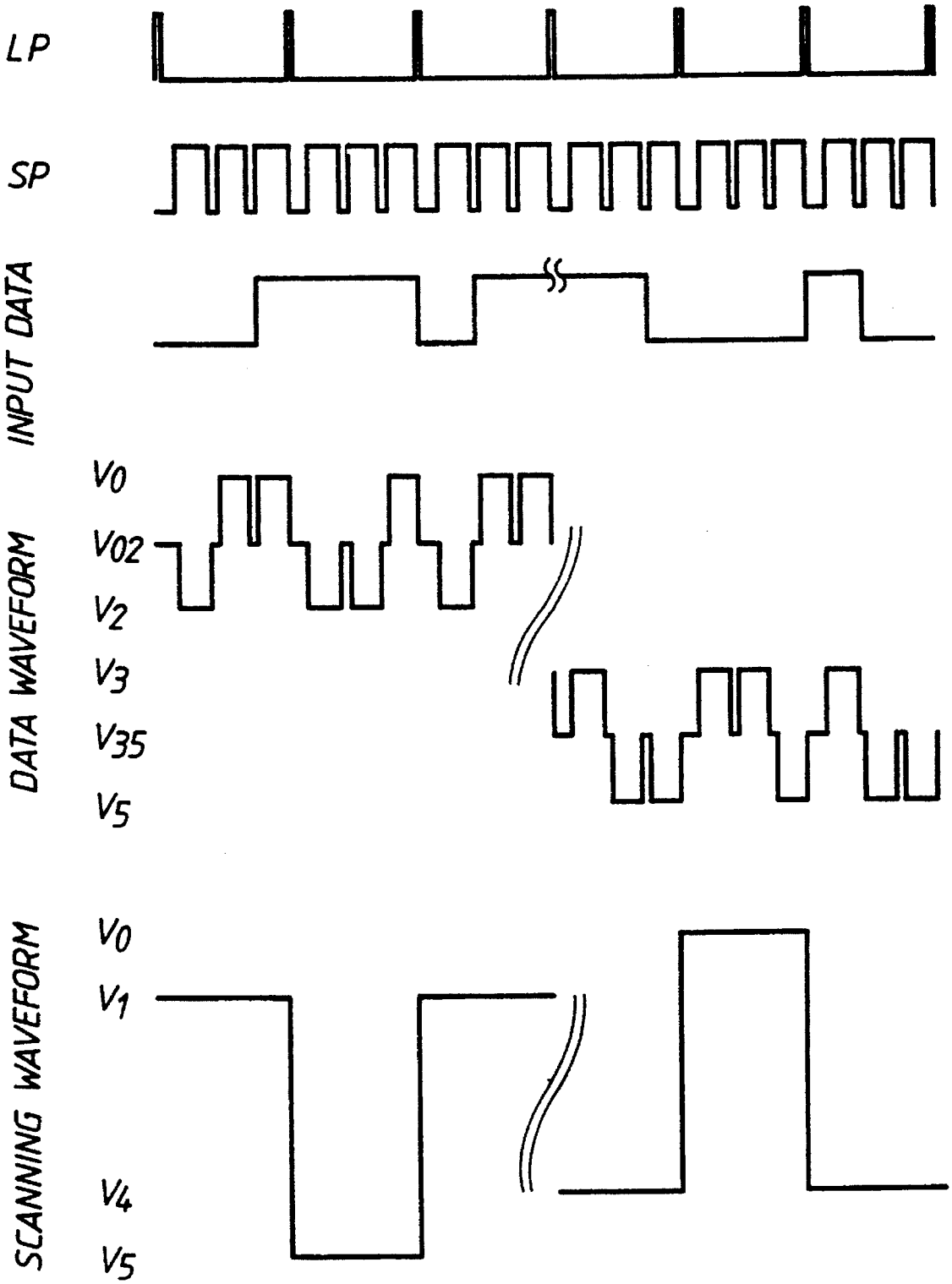
FIG. 22 is a waveform diagram to illustrate Embodiment 12 in the invention.
Figure 23:
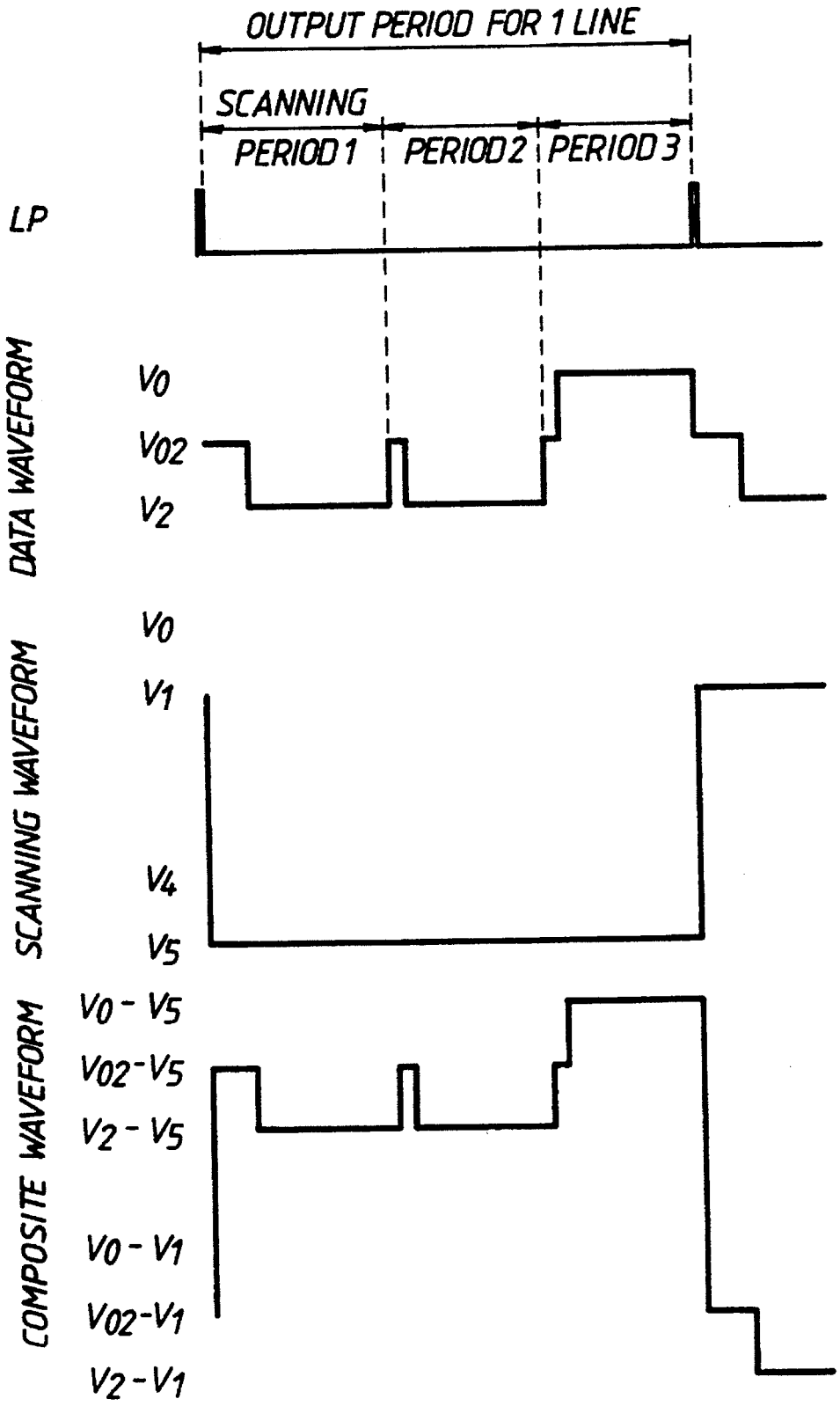
FIG. 23 is a waveform diagram to illustrate Embodiment 12 in the invention.
Figure 24:
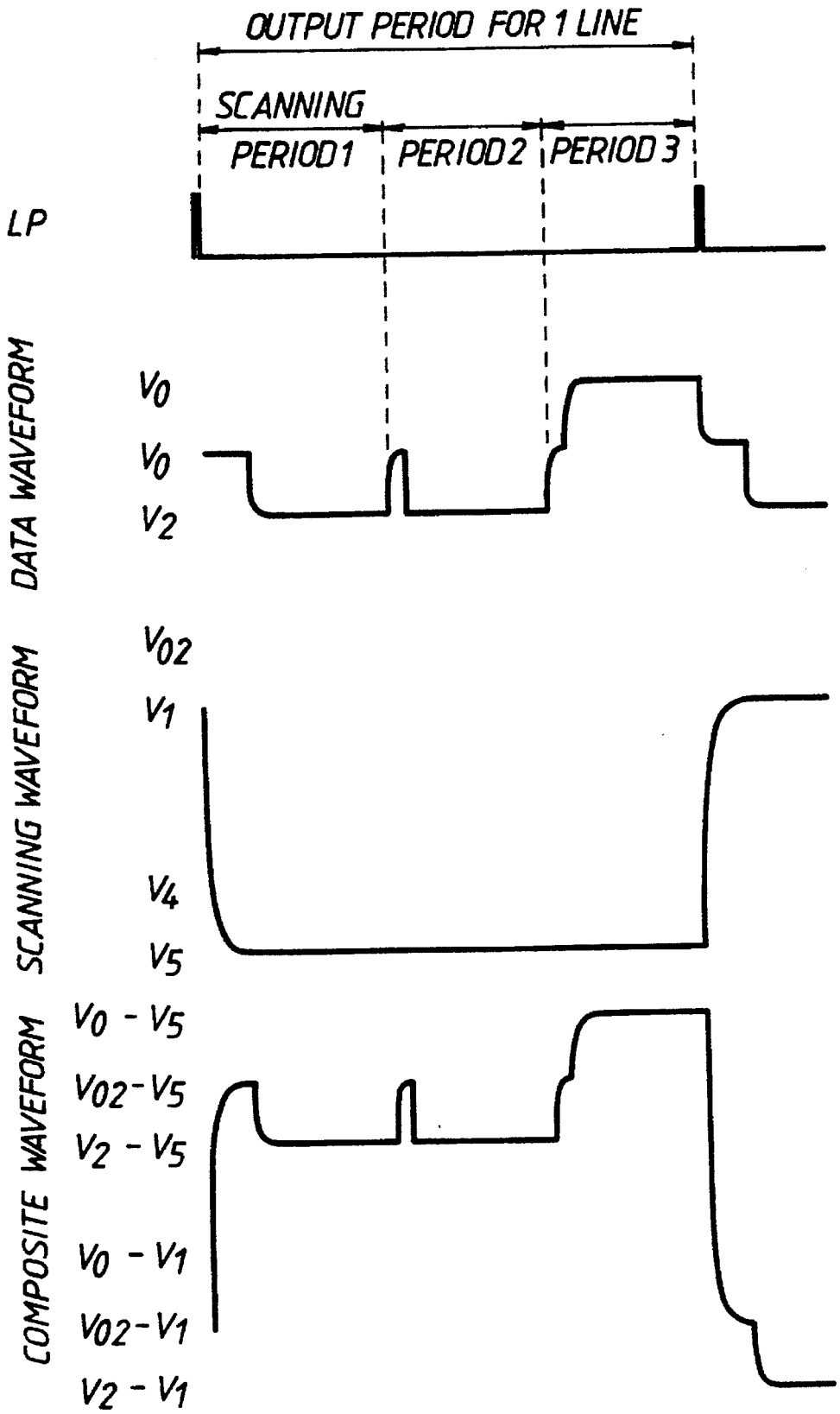
FIG. 24 is a waveform diagram to illustrate Embodiment 12 in the invention.

This was designed so that a 4 gray scale display could be achieved using the pulse width modulation method by altering the operation of the electrode drive unit in Embodiment 11 as shown in FIG. 22. In this case, writing per line was executed during a continuous 3-scan period. The number of clocks for the writing time per line was set at 160 clocks. The number of clocks in the first scanning period was set at 60 clocks, and the number of clocks in the second and third scanning periods was set at 50 clocks each. It operated so that the data electrode drive unit switched to voltage level Vdm between select voltage level Vds and non-select voltage level Vdn for the first 15 clocks in the first scanning period and for the first 5 clocks in each of the second and third scanning period. It was also designed so that delay time could be provided when this switching took place. FIG. 23 shows the operation of the electrode drive unit when delay time t0 was not provided in the state when the liquid crystal display device was not connected and FIG. 24 shows the operation when a delay time was provided. Also, FIGS. 23 and 24 show the composite waveform which was applied both between the output terminals of the data electrode drive unit and the output terminals of the scanning electrode drive unit.

The display quality was studied by connecting an electrode drive unit which operated in this way to the liquid crystal display device in the state in which a delay time was not provided. Since the driving conditions were made frame frequency 70Hz and duty ratio 1/200, the minimum pulse width was approximately 20 μs. By adjusting the level of intermediate voltage level Vdm, although there was a little display non-uniformity dependent on the distance from the output terminal of the scanning electrode drive unit, a uniform display with less display non-uniformity dependent on the display pattern was obtained.

Next, when this liquid crystal display system was driven by making delay time t0 greater and adjusting the delay time ty of the scanning waveform in the state with the liquid crystal display panel connected to scanning electrode drive unit 20 to 4 μs, and the delay time tx of the data waveform in the state with the liquid crystal display panel connected to data electrode drive unit 30 to 1 μs, there was hardly any display non-uniformity dependent on the distance from the output terminal of the scanning electrode drive unit, and a uniform display with even less display non-uniformity dependent on the display pattern was obtained.

Next, an embodiment of the ninth invention structural mode is described.

(Embodiment 13)

Figure 25:
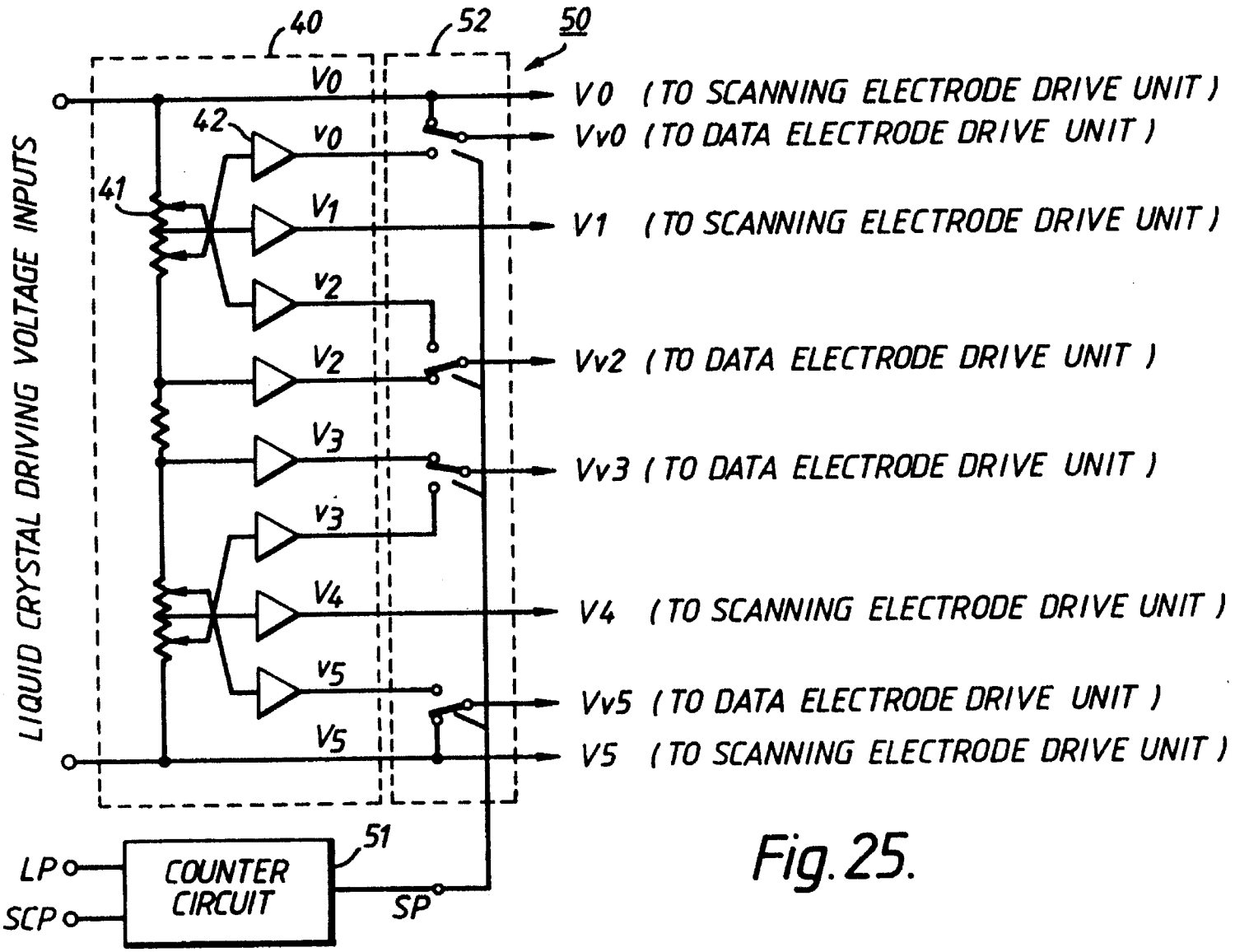
FIG. 25 is a circuit diagram to illustrate the power circuit and the voltage level control circuit of an embodiment (Embodiment 13) of the eighth aspect.

Power circuit 40 and voltage level control circuit 50 in Embodiment 1 were altered as shown in FIG. 25.

Power circuit 40 generates each voltage level V0, $v_0$, V1, $v_2$, V2, V3, $v_3$, V4, $v_5$, and V5 by potentiometer 41 and buffer 42, and these voltage levels in which V0 is the highest, gradually become lower, with V5 as the lowest.

Intermediate voltage levels $v_0$, $v_2$, $v_3$ and $v_5$ can be adjusted by potentiometer 41.

Figure 26:
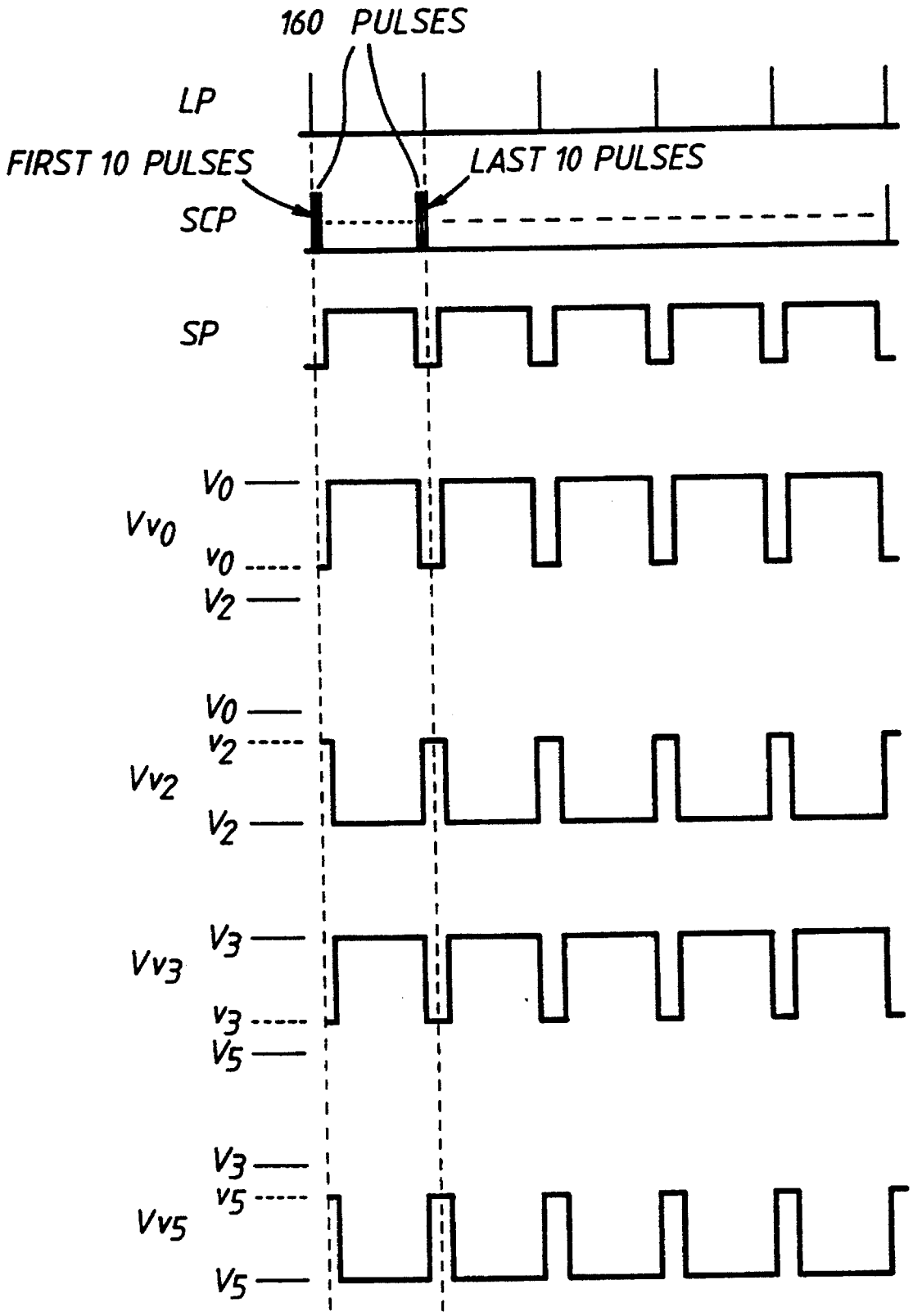
FIG. 26 is a waveform diagram to illustrate the eighth aspect in the invention.

Voltage level control circuit 50 is composed of counter circuit 51, which outputs switching pulse SP taking its timing by latch pulse LP and clock pulse SCP, and switching circuit 52, which executes switching of the power voltage level by the switching pulse. As shown in FIG. 26, this operates so that the voltage level of the data waveform becomes voltage levels $v_0$ and $v_2$ ($v_2$ and $v_5$ when inverted) roughly midway between select voltage level V0 (V5 when inverted), and non-select voltage level V2 (V3 when inverted), for a predetermined time every time the output of 1 line is executed, for instance before and after the data waveform output waveform, in this case during the first 10 clocks and the last 10 clocks, taking 1 scanning period as 160 clocks.

That is to say, Vv0, Vv2, Vv3 and Vv5 shown in FIG. 26 show binary voltages which are switched to binary voltage levels by switching circuit 52 shown in FIG. 25.

Vv0 has the value V0 when the data waveform is select voltage level, and has intermediate voltage level $v_0$ during the 10 clocks before and after that every scanning period.

Vv2 has the value V2 when the data waveform is select voltage level, and has intermediate voltage level $v_2$ during the 10 clocks before and after that every line.

Vv3 has the value V3 when the data waveform is select voltage level, and has intermediate voltage level $v_3$ during the 10 clocks before and after that every line.

Vv5 has the value V5 when the data waveform is select voltage level, and has intermediate voltage level $v_5$ during the 10 clocks before and after that every line.

Here, these values are adjusted by potentiometer 41 of power circuit 40 so that $$v_2>v_0 \text{ and } v_3<v_5$$

Figure 16:
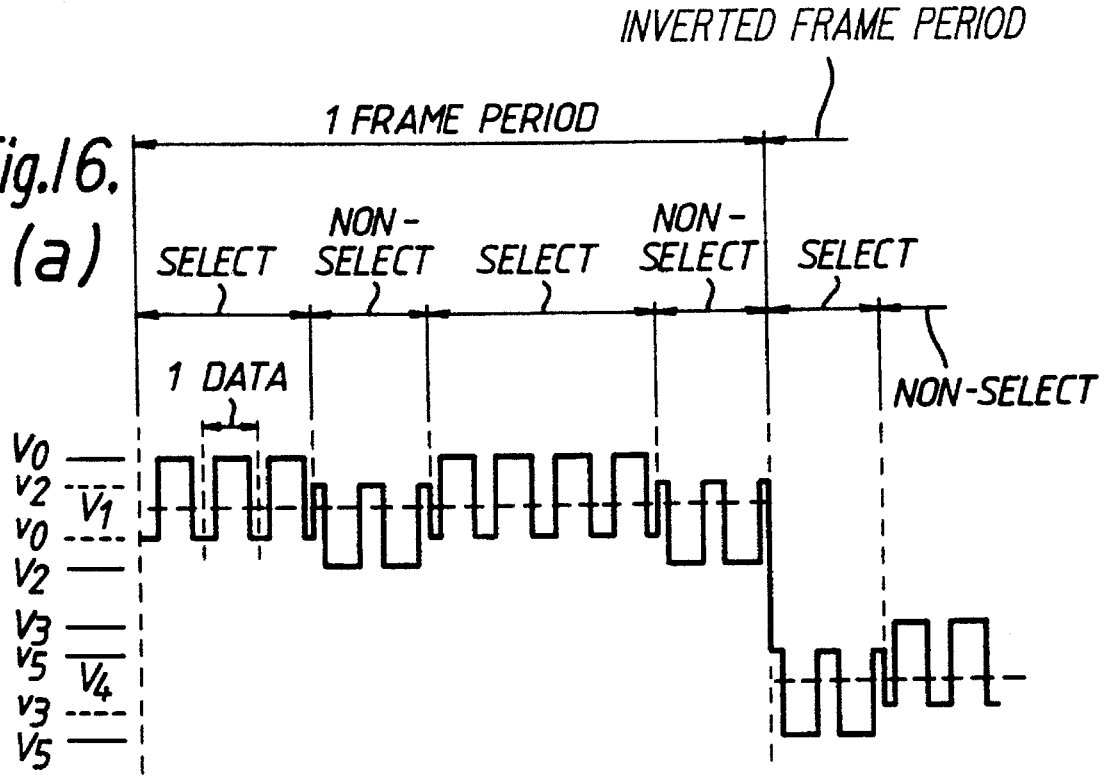
FIG. 16 is a waveform diagram to illustrate the ninth aspect in the invention.
Figure 16:
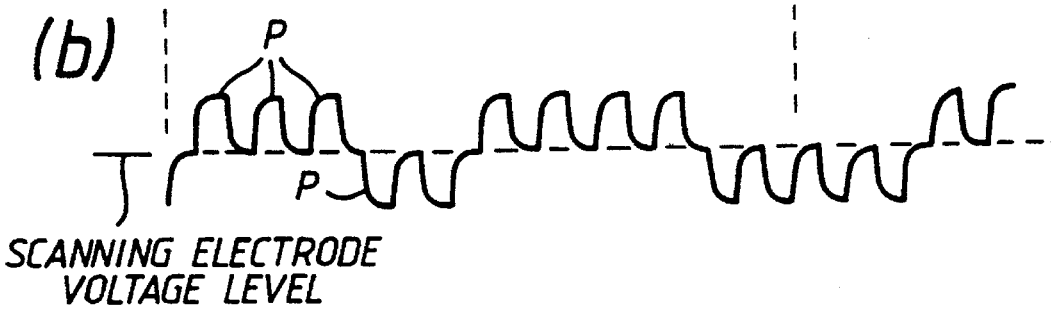

By this means, when a waveform such as shown in FIG. 16(*a*) is outputted from the data electrode drive unit and the scanning electrode voltage level is taken as a reference, the composite waveforms applied to the electrode intersection points for each pixel of a liquid crystal display panel become waveforms p of similar shapes in which distortion has occurred in every line, as in FIG. 16(*b*).

Incidentally, FIG. 16 shows the case in which the scanning waveform is non-select voltage level V1 (V4 when inverted).

When this waveform is compared with the waveform of prior art technology in FIG. 27, it is plain that, since a voltage of roughly the same waveform is applied to the pixels of each line, this shows that display non-uniformity will be eliminated.

In this embodiment, when a liquid crystal display panel was driven under the same conditions as in Embodiment 1, a uniform display with even less display non-uniformity dependent on the display pattern than in Embodiment 1 was obtained.

Also, when the display was carried out by inputting 16 gray scale data using the frame rate control method, in the same way as in the above cases, a uniform display with little display non-uniformity dependent on the display pattern was obtained, and all 16 gray scales could be discriminated.

Incidentally, in the above embodiments, the case of inserting a voltage level control circuit between the data electrode drive unit and the power circuit has been described. However, the function of the voltage level control circuit can also be provided to the data electrode drive unit or the power circuit.

Also, a direct current power source was used as the input power source to the prior art liquid crystal display system. However, in this invention, power source systems such as square wave may be added so that the driving waveform of this invention can be obtained.

In the sixth to eighth invention structural modes, a delay circuit which follows 1−exp(−t/CR) or exp(−t/CR) as functions of the rising and falling is used in the above embodiments. However, even without following these functions, a linear increment/decrement function or the increment/decrement portion of a SIN function with delays which signify time constant CR may also be used. Also, in the above embodiments, delay circuits were also provided to the electrode drive units. However, a voltage waveform with a delay time may also be obtained by adding delay circuits to the voltage level control circuits, or the like.

Furthermore, in the above embodiments, the case of driving a super-twist type liquid crystal display panel was described. However, this invention is not particularly limited to this, and may be applied to other liquid crystal display systems which execute multiplex drive, such as other modes of simple matrix type liquid crystal display systems or 2-terminal type active matrix type liquid crystal display systems.

In addition, needless to say, various modifications are possible within the limits of the technical concept of this invention, When using this invention, a liquid crystal display system with a uniform display in which there is extremely little display non-uniformity can be obtained.

We claim:

1. A liquid crystal display system driven by RMS voltage, comprising:

a liquid crystal display panel in which a scanning electrode group and a data electrode group, each including multiple electrodes, are positioned facing each other with a gap, liquid crystal is sandwiched between the electrodes and pixels are formed at the positions where the scanning electrode and the data electrodes cross each other, and an electrostatic capacity of the liquid crystal display panel differs depending on whether the liquid crystal is in an ON state or an OFF state;

a scanning electrode drive device directly connected to the scanning electrode group for outputting a pulse wave scanning waveform;

a data electrode drive device directly connected to the data electrode group for outputting a data waveform;

a voltage level control means in which the scanning waveform takes any of the select voltage level Vss, the non-select voltage level Vsn or the intermediate voltage level Vsm, which is a voltage level between select voltage level Vss and non-select voltage level Vsn, and which carries out at least one of switching from select voltage level Vss to non-select voltage level Vsn or switching from non-select voltage level Vsn to select voltage level Vss of the scanning waveform, stepping, using a series of at least three steps, through intermediate voltage level Vsm.

2. A liquid crystal display system driven by RMS voltage of claim 1 wherein the liquid crystal display system further comprises a control means in which the data waveform takes any of the select voltage level Vds, the non-select voltage level Vdn or the intermediate voltage level Vdm, which is a voltage level between the select voltage level Vds and the non-select voltage level Vdn, and which sets the data waveform at the intermediate voltage level Vdm, every scanning period, which is the output period for the minimum unit display information which determines the liquid crystal display state, for a predetermined period which is at least either at the beginning or the end of the scanning period.

3. A liquid crystal display system driven by RMS voltage of claim 2 wherein the liquid crystal display system comprises a means which, when the select voltage levels Vds of respective inverted data waveforms are taken as Vo and V5 and the non-select voltage levels Vdn as V2 and V3, and the select voltage levels Vss of respective inverted scanning waveforms are taken as V0 and V5 and the non-select voltage levels Vsm as V1 and V4, sets the respective voltage levels in the relationship $$V0>V1>V2>V3>V4>V5$$

and also in the relationship $$(V0-V1)+(V4-V5)>(V1-V2)+(V3-V4).$$

4. A liquid crystal display system driven by RMS voltage of claim 3 wherein the liquid crystal display system comprises a means which, when the select voltage levels Vds of respective inverted data waveforms are taken as V0 and V5, the non-select voltage levels Vdn as V2 and V3 and the intermediate voltage levels Vdm as V02 and V35, and the select voltage levels Vss of respective inverted scanning waveforms are taken as V0 and V5 and the non-select voltage levels Vsn as V1 and V4, the respective voltage levels are in the relationship $$V0>V02>V1>V2>V3>V4>V35>V5.$$

5. A liquid crystal display system comprising:

a liquid crystal display panel in which a scanning electrode group and a data electrode group, each including multiple electrodes, are positioned facing each other with a gap, liquid crystal is sandwiched between the electrodes and pixels are formed at the positions where the scanning electrodes and the data electrodes cross each other, and an electrostatic capacity of the liquid crystal display panel differs depending on whether the liquid crystal is in an ON state or an OFF state;

a scanning electrode drive device which is directly connected to the scanning electrode group and outputs a scanning waveform containing a select voltage level Vss and a non-select voltage level Vsn;

a data electrode drive device which is directly connected to the data electrode group and outputs a data waveform containing a select voltage level Vds and a non-select voltage level Vdn;

a first voltage level control means for setting the data waveform at a voltage level which is either the select voltage level Vds, the non-select voltage level Vdn or an intermediate voltage level Vdm which is a voltage level between the select voltage level Vds and the non-select voltage level Vdn;

a second voltage level control means for setting the data waveform at an intermediate voltage level Vdm every scanning period, which is the output period for a minimum unit display information which determines the liquid crystal display state, for a predetermined period which is at least either at the beginning or the end of the scanning period;

a third voltage level control means for controlling the scanning electrode drive device and the data electrode drive device so that the period in which the scanning waveform takes select voltage level Vss longer than the period in which the data waveform takes select voltage level Vds or non-select voltage level Vdn every scanning period; and a means which, when the select voltage levels Vds of respective inverted data waveforms are taken as V0 and V5 and the non-select voltage levels Vdn as V2 and V3, and the select voltage levels Vss of respective inverted scanning waveforms are taken as V0 and V5 and the non-select voltage levels Vsm as V1 and V4, sets the respective voltage levels in the relationship $$V0>V1>V2>V3>V4>V5$$

and also in the relationship $$(V0-V1)+(V4-V5)>(V1-V2)+(V3-V4).$$

6. A liquid crystal display system comprising:

a liquid crystal display panel in which a scanning electrode group and a data electrode group, each including multiple electrodes, are positioned facing each other with a gap, liquid crystal is sandwiched between the electrodes and pixels are formed at the positions where the scanning electrode and the data electrodes cross each other, and an electrostatic capacity of the liquid crystal display panel differs depending on whether the liquid crystal is in an ON state or an OFF state;

a scanning electrode drive device directly connected to the scanning electrode group for outputting a pulse wave scanning waveform;

a data electrode drive device directly connected to the data electrode group for outputting a data waveform;

a voltage level control means for controlling the scanning electrode drive device such that the scanning waveform takes any of the select voltage level Vss, the non-select voltage level Vsn or the intermediate voltage level Vsm, which is a voltage level between select voltage level Vss and non-select voltage level Vsn, and which carries out at least one of switching from select voltage level Vss to non-select voltage level Vsn or switching from non-select voltage level Vsn to select voltage level Vss of the scanning waveform, stepping through intermediate voltage level Vsm; and a means which, when the select voltage levels Vds of respective inverted data waveforms are taken as V0 and V5 and the non-select voltage levels Vdn as V2 and V3, and the select voltage levels Vss of respective inverted scanning waveforms are taken as V0 and V5 and the non-select voltage levels Vsm as V1 and V4, sets the respective voltage levels in the relationship $$V0>V1>V2>V3>V4>V5$$

and also in the relationship $$(V0-V1)+(V4-V5)>(V1-V2)+(V3V4).$$

7. A liquid crystal display system of claim 6 wherein the liquid crystal display system further comprises a control means in which the data waveform takes any of the select voltage level Vds, the non-select voltage level Vdn or the intermediate voltage level Vdm, which is a voltage level between the select voltage level Vds and the non-select voltage level Vdn, and which sets the data waveform at the intermediate voltage level Vdm, every scanning period, which is the output period for a minimum unit display information which determines the liquid crystal display state, for a predetermined period which is at least either at the beginning or the end of the scanning period.

* * * * *